US008646835B2

(12) United States Patent
Homans et al.

(10) Patent No.: US 8,646,835 B2
(45) Date of Patent: Feb. 11, 2014

(54) SYSTEMS AND METHODS FOR PORTABLE FURNITURE

(75) Inventors: Samuel B. Homans, Oakland, CA (US); Tae Wan Kim, San Francisco, CA (US)

(73) Assignee: Alite Designs, Inc., San Francisco, CA (US)

( * ) Notice: Subject to any disclaimer, the term of this patent is extended or adjusted under 35 U.S.C. 154(b) by 72 days.

(21) Appl. No.: 13/483,743

(22) Filed: May 30, 2012

(65) Prior Publication Data

US 2012/0326470 A1 Dec. 27, 2012

Related U.S. Application Data

(63) Continuation-in-part of application No. 12/050,117, filed on Mar. 17, 2008, now Pat. No. 8,205,934.

(51) Int. Cl.
*A47C 4/00* (2006.01)

(52) U.S. Cl.
USPC ..... 297/16.2; 297/16.1; 297/45; 297/440.11; 297/17.4

(58) Field of Classification Search
USPC ..... 297/13.2, 45, 48, 56, 451.3, 440.11, 297/440.24, 16.1, 17.4, 452.13
See application file for complete search history.

(56) References Cited

U.S. PATENT DOCUMENTS

| | | | | | |
|---|---|---|---|---|---|
| 180,074 | A | * | 7/1876 | Skinner | 248/155.2 |
| 2,099,345 | A | * | 11/1937 | Olszanowski | 297/4 |
| 2,257,831 | A | * | 10/1941 | Wood | 280/812 |
| 2,567,595 | A | * | 9/1951 | Bryant | 108/116 |
| 2,691,410 | A | * | 10/1954 | Boucher | 297/45 |
| 3,266,839 | A | * | 8/1966 | Combs | 297/57 |
| 3,312,437 | A | * | 4/1967 | Barth | 248/158 |
| 3,432,162 | A | * | 3/1969 | Flemming | 482/77 |
| 3,538,512 | A | * | 11/1970 | Dolan | 2/227 |
| 3,884,524 | A | * | 5/1975 | Eberle | 297/160 |
| 4,095,842 | A | * | 6/1978 | Tretick | 297/4 |
| 4,101,163 | A | * | 7/1978 | Morin | 297/16.1 |
| 4,671,566 | A | * | 6/1987 | Knapp et al. | 297/16.2 |
| 4,685,725 | A | * | 8/1987 | Helfrich | 297/45 |
| 4,810,029 | A | * | 3/1989 | Kaladis et al. | 297/16.2 |
| 4,892,352 | A | * | 1/1990 | Haywood | 297/195.11 |
| 4,930,839 | A | * | 6/1990 | Saito et al. | 297/338 |
| 5,927,797 | A | * | 7/1999 | Ferguson | 297/4 |
| 5,979,976 | A | * | 11/1999 | Ferencik | 297/16.1 |
| 6,045,177 | A | * | 4/2000 | Grace | 297/45 |
| 6,062,638 | A | * | 5/2000 | Ferguson | 297/4 |
| 6,485,095 | B2 | * | 11/2002 | Haubeil | 297/16.1 |
| 6,834,916 | B2 | * | 12/2004 | Volkman et al. | 297/270.1 |
| 6,893,097 | B1 | * | 5/2005 | Ebensperger et al. | 297/451.4 |
| 6,926,355 | B2 | * | 8/2005 | Le Gette et al. | 297/16.2 |
| 7,044,267 | B2 | * | 5/2006 | Sigler | 182/15 |
| 7,198,324 | B2 | * | 4/2007 | Le Gette et al. | 297/16.2 |
| 7,328,940 | B2 | * | 2/2008 | Zheng et al. | 297/44 |
| D565,332 | S | * | 4/2008 | Erickson | D6/501 |
| 7,384,097 | B2 | * | 6/2008 | Park et al. | 297/45 |
| 7,681,267 | B1 | * | 3/2010 | Hall | 5/655 |

* cited by examiner

*Primary Examiner* — Laurie Cranmer
(74) *Attorney, Agent, or Firm* — Kang S. Lim

(57) ABSTRACT

The present invention relates to lightweight collapsible portable chairs. In one embodiment, the portable chair has a sling and a chair frame which includes a first pair of bars and a second pair of bars. Each bar of the first pair of bars includes a joint configured to contact a ground surface. In another embodiment, the chair frame includes a front of bars, a back pair of bars, a pair of joints and a center bar configured to securely couple the pair of back joints to each other. In some embodiments, the chair frame includes a front support assembly. In other embodiments, the chair frame includes a pair of lower bars.

5 Claims, 18 Drawing Sheets

SYSTEMS AND METHODS FOR PORTABLE FURNITURE

CROSS REFERENCE TO RELATED APPLICATIONS

This is a continuation-in-part of U.S. application Ser. No. 12/050,117 filed on Mar. 17, 2008 entitled "Portable Chair", by Samuel B. Homans, which is hereby fully incorporated by reference.

BACKGROUND

The present invention relates to systems and methods for portable furniture. In particular, the invention relates to portable, lightweight and collapsible stable chairs well suited for camping and travelling.

Conventional portable chairs are not truly portable for outdoor use and cannot accommodate sitting on a hillside or uneven terrain. An example of one such portable chair is a "stadium seat" which consists of two flat pads with a hinge in the middle, rigid posts along their outer lateral edges and adjustable straps that run on each side of the pads from the top corner to the bottom corner. In a stadium seat, when a user leans back, the sides of the pads and posts are pulled in towards the body along with the straps, and generally, the heavier the user is, the more uncomfortable the stadium seat is. Further, the user cannot use this chair to sit comfortably on a hillside or on uneven terrain.

Thus, there is a need in the chair field to create new, useful, portable, stable and comfortable chairs. These improved portable chairs are strong, lightweight and collapsible, and are well suited for use on uneven terrain often encountered outdoors.

SUMMARY

To achieve the foregoing and in accordance with the present invention, systems and methods for constructing portable furniture is provided. In particular, the invention provides portable, lightweight and collapsible stable chairs well suited for camping and travelling.

In one embodiment, a portable chair, for accommodating a user in a seated position, has a sling and a chair frame which includes a first pair of bars and a second pair of bars. The first pair of bars that are each collapsible and include at least two bar sections that are each substantially identical and configured to be removably coupled to each other, each of the first pair of bars having a first end and a second end. Each of the second pair of bars has a first end configured to be arranged substantially toward the front of the chair and a second end configured to be arranged substantially toward the back of the chair. The first end of each bar of the first pair of bars is configured to be coupled to the first end of each bar of the second pair of bars, and each bar of the first pair of bars includes a joint configured to provide a point of contact with a ground surface and further configured to be couple a first bar section to a second bar section.

In another embodiment, the chair frame includes a front of bars, a back pair of bars, a pair of joints and a center bar. Each of the front pair of collapsible bars has a first end and a second end. Each of the back pair of collapsible bars has a first end and a second end. Each of the pair of joints is configured to be coupled to the corresponding first end of each of the front pair of collapsible bar and also to be coupled to the corresponding first end of the back pair of collapsible bars. The center bar is configured to securely couple the pair of back joints to each other.

In some embodiments, the chair frame may include a front chair support having a pair of front joints configured to be coupled to a corresponding pair of bars, and wherein the front chair support is further configured to contact a ground surface.

In other embodiments, the portable chair frame may include a first set of lower bars and a second set of lower bars. The first set of lower bars are each collapsible and include at least one bar sections that are removably coupled to each other, each of the first set of lower bars having a first end and a second end. The second set of lower bars are each collapsible and include at least one bar section that is removably coupled to each other, each of the first set of lower bars having a first end and a second end. Each corresponding joint of the first pair of bars is configured to couple first set of lower bars and second set of lower bars, and each end of lower bars configured to provide a point of contact with a ground surface.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which.

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

The present invention relates to systems and methods for constructing portable, lightweight and collapsible stable chairs well suited for camping and travelling. To facilitate discussion, FIGS. 1-24 illustrate several embodiments of portable chairs in accordance to the present invention.

Figure 1:
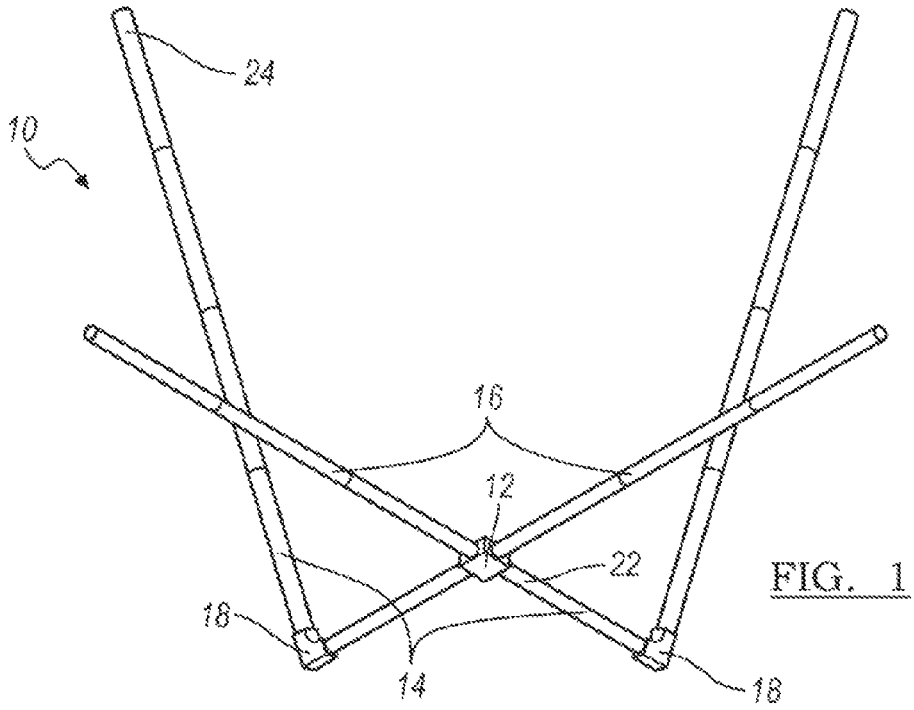
FIG. 1 is a perspective view of one embodiment of a portable chair frame in accordance with the present invention.
Figure 2:
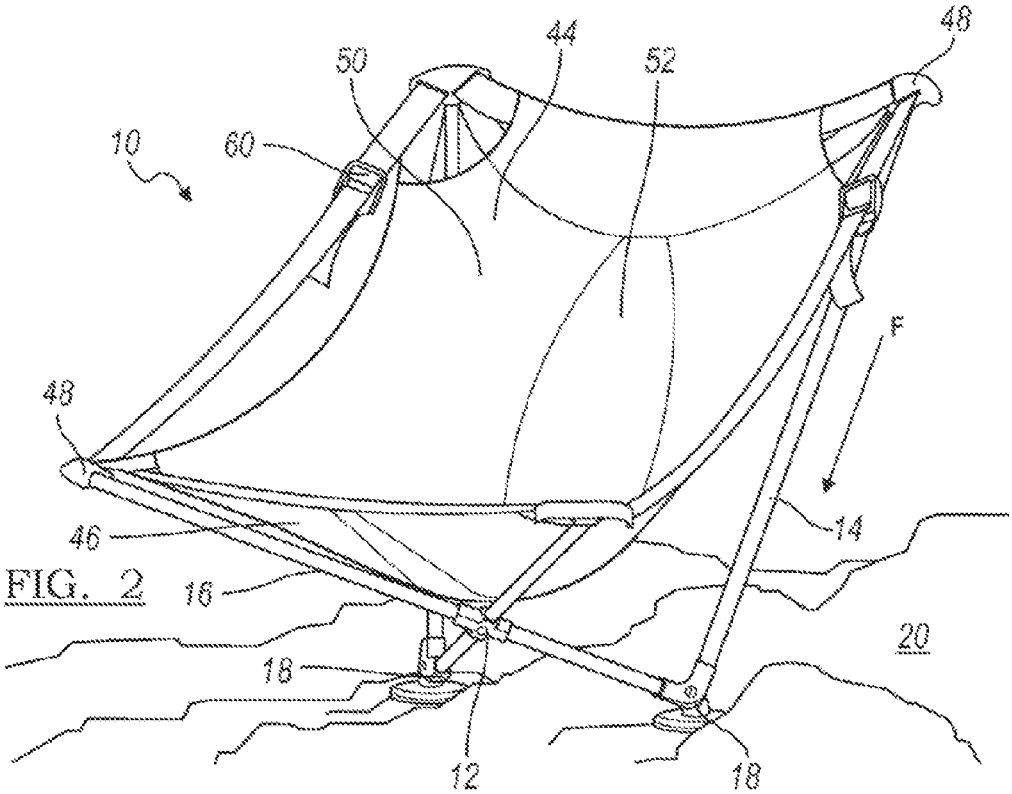
FIG. 2 illustrates the portable chair frame supporting a sling of the embodiment of FIG. 1.

As shown in FIGS. 1 and 2, the portable chair frame 10 that supports a sling of the described embodiments includes a first pair of collapsible bars 14, a second pair of collapsible bars 16, and two joints 18 that each provide a point of contact with a ground surface 20. Each collapsible bar has a first end 22 coupled to the other first ends 22 and a second end 24 that provides a sling interface for the sling. The joints 18 are included in each of the collapsible bars of the first pair of collapsible bars 14. The portable chair frame 10 further includes a brace coupled to the first ends 22 of the collapsible bars. The portable chair frame 10 is configured to support a sling and, more specifically, a portable chair frame that supports a sling designed for use on uneven terrain. In use, a user can sit in the sling supported by the portable chair frame 10. The portable chair frame 10 provides two points of contact with a ground surface 20, and the user provides a third point of contact with the ground surface 20 with their feet or legs. The joints 18 prevent rotation of the chair about a single axis (i.e., preventing the chair from rotating from side to side, while allowing the chair to rock back and forth), while the user uses their legs and/or feet to stabilize the chair about a second axis (i.e., controlled rocking back and forth or preventing it all together). The portable chair frame 10 that supports a sling, however, may be alternatively used in any suitable environment and for any suitable reason.

I. A Portable Chair Frame Embodiment

In this embodiment, the brace 12 functions to couple the first pair of collapsible bars 14 to the second pair of collapsible bars 16 and to hold the joints 18 a first distance from one another and to hold the second ends 24, which provide the sling interface, a second distance from one another. The first distance of the joints 18 can be less than the second distance of the second ends 24 such that the first pair of collapsible bars that each can run from two second ends 24 to the two joints 18 (the points of contact with a ground surface) are substantially parallel or inline with a generated force vector F, as shown in FIG. 2. The force vector is generated when a user sits in the sling, and their weight, supported by the sling, is transferred to the frame. The sling "pulls" on the frame, generating a force vector F in the direction shown. Due to the fact that the first collapsible bars are substantially parallel or inline with the generated force vector F, they are optimally positioned to support the force and are less likely to buckle, or fail in any other fashion.

Figure 5:
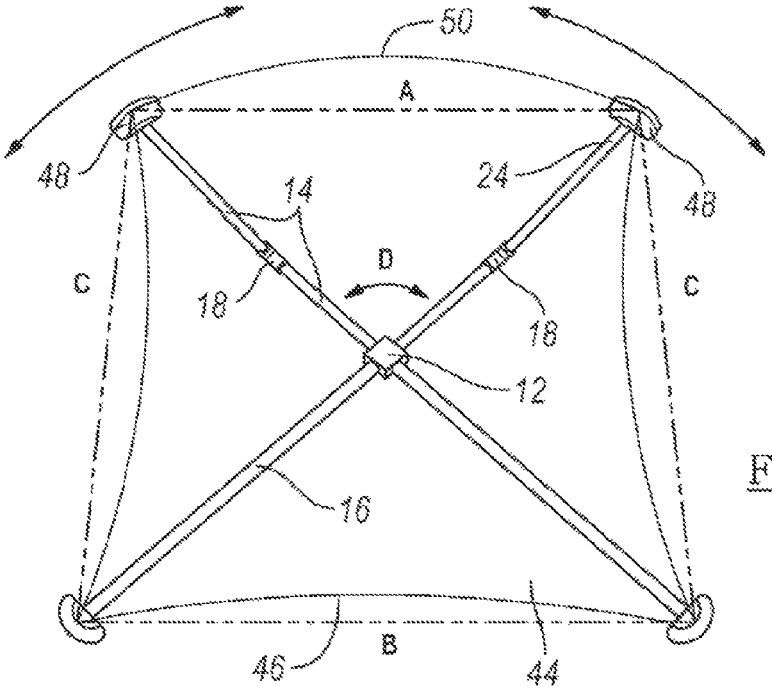
FIG. 5 shows the portable chair frame for the embodiment of FIG. 1.

Additionally as shown in FIG. 5, the brace 12 holds the first ends of the first pair of bars 14 at a positive angle D less than 180 degrees (approximately 70 to 110 degrees) which constrains the joints to rotate around the axes at angle D to one another. Therefore, the joints themselves are rigid and the sling interfaces 48 at the second ends 24 of the first bars 14 rotate in planes at angle D to one another. The sling interfaces 48 are also constrained in their movement by the sling itself. The upper portion 50 of the sling links together the sling interfaces at the second ends 24 of the first pair of collapsible bars such that the distance A between them cannot increase. The second pair of bars 16 are fixed in space so that their second ends 24 are at a fixed distance B from one another. This distance B can be greater than distance A. For the distance A to decrease, the distances C along the lateral edges of the sling would have to increase. Therefore the sling is held open when unoccupied. By the same token, when a user is seated in the sling, while the users weight exerts a force on the sling that tends to pull the upper sling interfaces together, the force is resisted by the lateral edge of the sling and especially by the adjustment element 60 which are both connected to the fixed second ends of the second bars.

Additionally, the brace couples the first pair of collapsible bars 14 to the second pair of collapsible bars 16 such that the lines of the bars cross at the brace. This arrangement helps the frame push the second ends 24 that provide a sling interface away from one another rather than towards one another due to the weight of the user. The brace 12 is located close to the sling such that is minimizes the bending forces of the bars, and such that it is above the ground surface to allow the joints 18 to contact an uneven ground surface. The uneven ground surface is able to cross through the line and/or break the plane created by the two points of contact of the joints 18, as shown in FIG. 2, such that the ground surface can be sand, rock, hillside, or any other suitable uneven terrain.

Figure 3A:
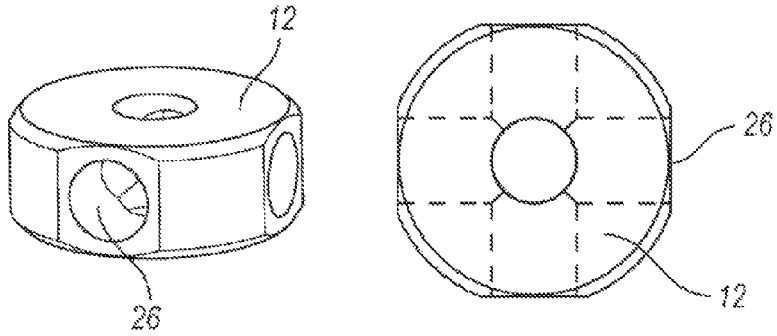
FIG. 3A is a side view and a top view of the brace for the embodiment of FIG. 1.
Figure 3B:
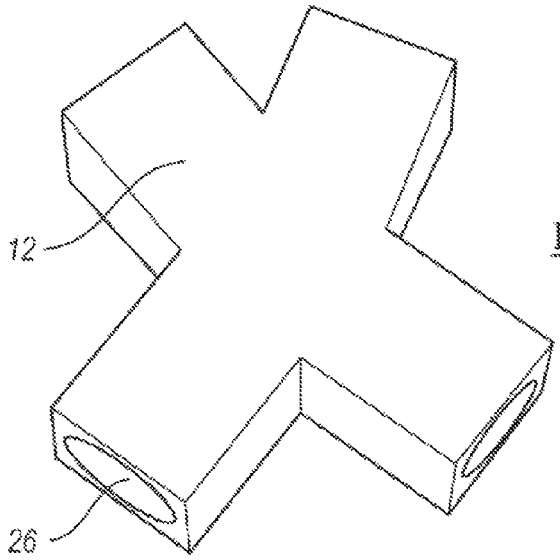
FIG. 3B is a perspective view of an alternate brace for the embodiment of FIG. 1.
Figure 4:
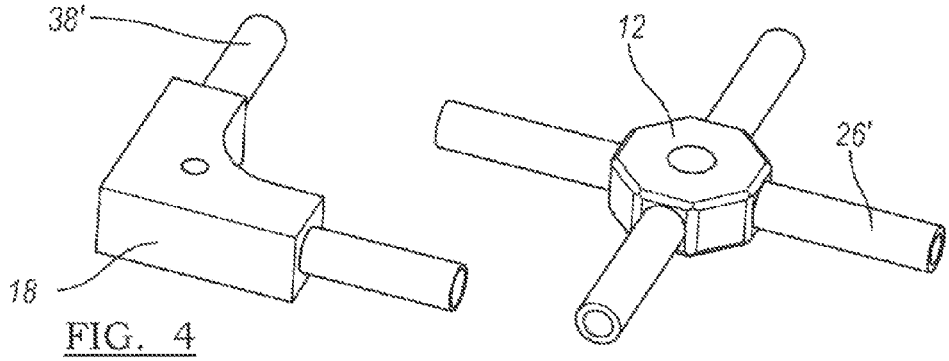
FIG. 4 illustrates the brace and the joint for the embodiment of FIG. 1.

The brace 12 is one of several variations. As shown in FIGS. 3A and 4, a first variation of the brace 12 includes four receiving elements 26. The receiving elements each receive a portion of a collapsible bar such that the brace and the collapsible bars inserted into the receiving elements are in substantially the same plane. The brace and the receiving elements restrict movement of the collapsible bars in at least one direction. The collapsible bars may pivot or rotate with respect to the brace, such that they may fold up over or with the brace. Alternatively, the collapsible bars may be fixed by the brace. As shown in FIG. 3A, the receiving elements position the collapsible bars inserted into the receiving elements at substantially right angles to one another, but may alternatively position the collapsible bars inserted into the receiving elements at any suitable angle to one another, including a combination of different angles, as shown in FIG. 3B. The brace 12 may have any suitable geometry to define the four receiving elements 26, such as a cross shape as shown in FIG. 3B. In a first version of the first variation, as shown in FIG. 3A, the brace 12 is cylindrical and defines a cavity that receives a portion of a collapsible bar. The cavity can be cylindrically shaped, but may alternatively have any suitable shape such that it receives a portion of a collapsible bar.

In a second version of the first variation, as shown in FIG. 4, the brace 12 is cylindrical and defines a center hole to reduce the mass of the brace 12 and functions to receive a portion of a collapsible bar around the outer diameter of the cylindrical receiving element or inside the inner diameter of the cylindrical receiving element. The receiving elements are coupled such that a cord or a portion of a collapsible bar may run from one receiving element to another receiving element. Although the brace 12 and the receiving elements 26 can be one of these two versions of the first variation, the brace 12 and the receiving elements 26 may be any suitable element to couple the first pair of collapsible bars 14 to the second pair of collapsible bars 16 and to hold the joints 18 a first distance from one another.

Although the brace 12 can be one of these several variations, the brace may alternatively be any suitable mechanism to couple the first pair of collapsible bars 14 to the second pair of collapsible bars 16 and to hold the joints 18 a first distance from one another and hold the second ends 24, which provide the sling interface, a second distance from one another.

The bars of the described embodiments function to support the sling and the weight of a user. The bars can be one of several variations. As shown in FIG. 2, the bars (the first pair of bars 14 and the second pair of bars 16) are cylindrical rods, but may alternatively have any suitable geometry and may have varying geometries along the length of the rods. The bars are straight or linear bars, but may alternatively be curved, bent, or have any other suitable geometry. The bars can be made of metal (such as 0.433" 7075 T9 aluminum poles with a 0.030" wall thickness), or plastic, but may be alternatively made from any suitable material. The bars 14 and 16 are collapsible or foldable such that they include multiple sections that can be assembled to support the sling and the weight of the user and can be disassembled for easy transportation and storage. Each of the sections are straight, but may alternatively be curved or angled. Each section may have the same radius of curvature or angle, but alternatively each section may have a different radius of curvature or angle.

Figure 6:
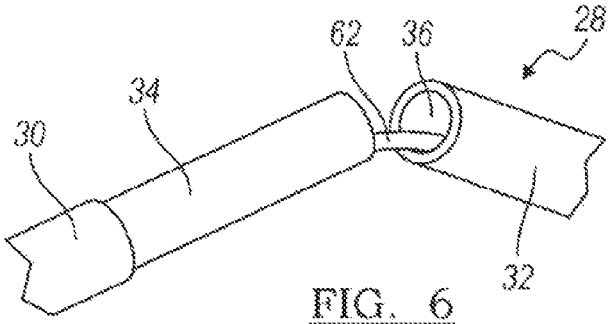
FIG. 6 shows the first bar section and the second bar section for the embodiment of FIG. 1.

As shown in FIG. 6, the collapsible bar 28 includes a first bar section 30 and a second bar section 32 removably coupled to a first bar section 30. The first bar section 30 has an end portion with an outer diameter dimension 34 and the second bar section 32 has an end portion that defines a recess 36 that receives the outer diameter dimension 34 of the end portion of the first bar section 30. The outer diameter dimension 34 has a diameter less than the outer diameter of the collapsible bar. For example, they may have 0.370" outer diameter while the collapsible bars have an outer diameter of 0.433". The end portion of the first bar section 30 may be a separate piece that is coupled to the first bar section 30. For example, the separate piece may have an outer diameter of 0.433" with a 0.040" wall thickness. Alternatively, the first bar section may couple to the second bar section in any other suitable fashion. The first bar section 30 is substantially identical to the second bar section 32, but alternatively, the first bar section 30 and the second bar section 32 may have different geometries, dimensions, and/or cross sections. Each collapsible bar can include any suitable number of bar sections. In a first variation, as shown in FIG. 2, the first pair of collapsible bars 14 and the second pair of collapsible bars 16 each include multiple bar sections. The joint 18 of the first pair of collapsible bars 14 couples one bar section to multiple bar sections at a substantially right angle. The joint 18 may alternatively couple any suitable combination of bar sections at any suitable angle to one another.

Figure 7:
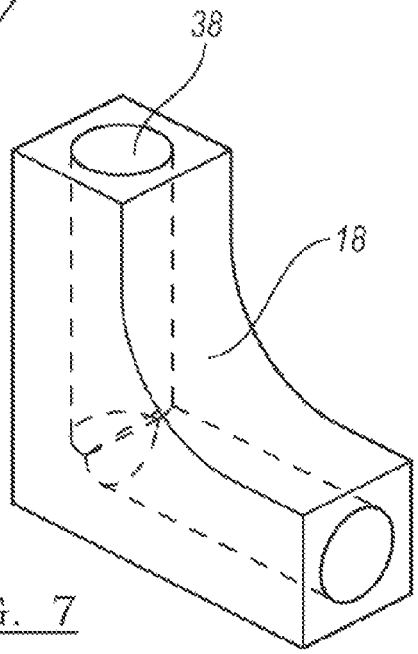
FIG. 7 is a perspective view of the joint for the embodiment of FIG. 1.

The joints 18 of the described embodiments function to provide a point of contact with a ground surface 20. The joints 18 can be one of several variations. In a first variation, as shown in FIG. 7, the joints 18 define two receiving elements 38. The receiving elements each receive a portion of a collapsible bar such that the joint and the bars inserted into the receiving elements are in substantially the same plane. As shown in FIG. 7, the receiving elements position the bars inserted into the receiving elements at substantially a right angle to one another, but may alternatively position the bars inserted into the receiving elements at any suitable angle to one another. The joint 18 may have any suitable geometry to define the two receiving elements 38. In a first variation, as shown in FIG. 7, the joint 18 is L-shaped and the receiving element can be a cavity that receives a portion of a collapsible bar. The L-shaped joint has a pointed vertex, but may alternatively have a curved or flat vertex. The cavity is cylindrically shaped, but may alternatively have any suitable shape such that it receives a portion of a collapsible bar.

In a second variation, as shown in FIG. 4, the receiving element 38' is a cylindrical receiving element that functions to receive a portion of a collapsible bar around the outer diameter of the cylindrical receiving element or inside the inner diameter of the cylindrical receiving element. The receiving elements are coupled such that a cord or a portion of a collapsible bar may run from one receiving element to another receiving element. In an alternative variation, the joint 18 may be formed by bending a portion of a bar and the bar may be curved or bent to form the joint 18. The joint 18 can be made of metal (such as aluminum) or plastic, but may be alternatively made from any suitable material. Although the joint 18 and the receiving elements 38 can be one of these variations, the joint 18 and the receiving elements 38 may be any suitable element to support the sling and the weight of a user.

Figure 8:
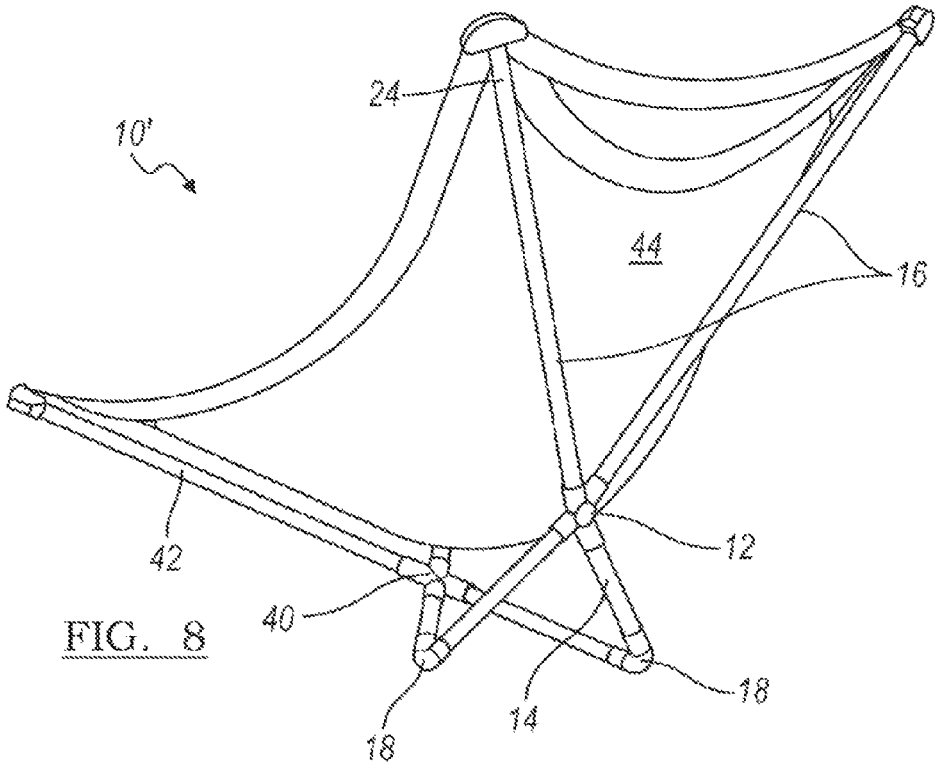
FIG. 8 shows the portable chair frame supporting a sling of an alternate embodiment of the present invention.

As shown in FIG. 8, the portable chair frame 10' of the second embodiment is nearly identical to the portable chair frame 10 of the first embodiment. The difference between the two embodiments, however, is that the portable chair frame 10' of the second embodiment further includes a second brace 40 and a third pair of collapsible bars 42. In this embodiment, the first pair of collapsible bars 14, including the joints 18, have a first end coupled to the first brace 12 and a second end coupled to the second brace 40 and the third pair of collapsible bars 42 each have a first end coupled to the second brace 40 and a second end 24 that provides a sling interface.

II. A Sling (Seat) Embodiment

The portable chair frame 10 of the described embodiments also includes a sling 44, which is supported by the portable chair frame 10 and supports the weight of a user. As shown in FIG. 2, the sling 44 includes a seat bottom portion 46 with frame interface elements 48 and a seat back portion 50 with frame interface elements 48. The frame interface elements 48 are coupled to the four sling interfaces of the collapsible bars. The four frame elements are coupled to the sling and removably coupled to the portable chair frame, but may alternatively be removably coupled to the sling and coupled to the portable chair frame, removably coupled to both, or coupled to both. In a first variation, as shown in FIG. 2, the frame interface elements 48 of the seat back portion 50 couple to the first pair of collapsible bars 14 and the frame interface elements 48 of the seat bottom portion 46 couple to a second pair of collapsible bars 16 such that the brace 12 is substantially adjacent or below the seat bottom portion 46 of the sling.

Figure 9:
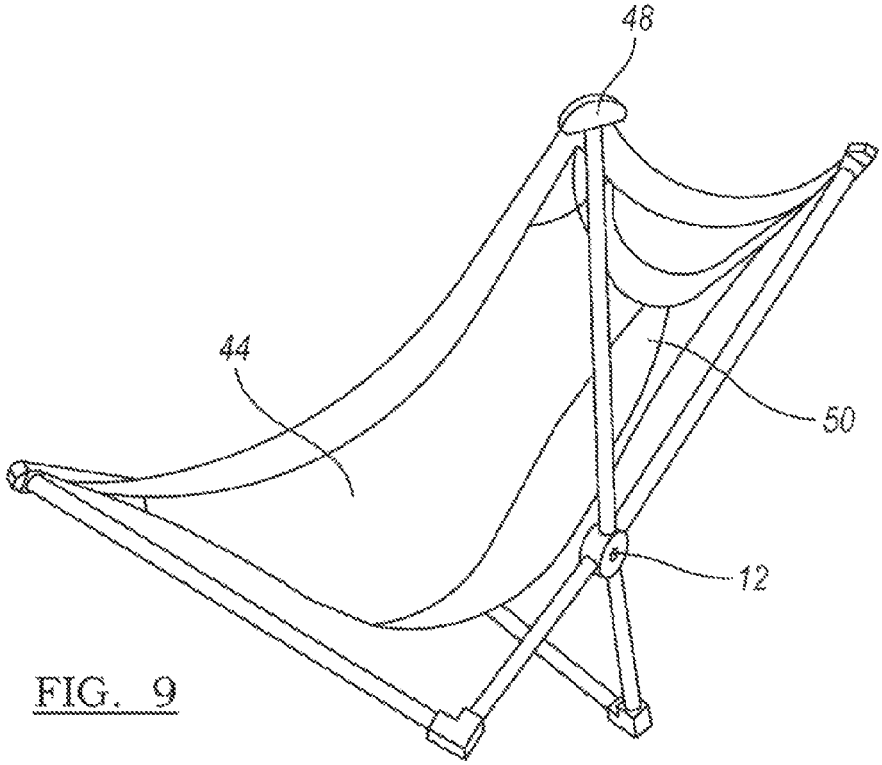
FIG. 9 shows the portable chair frame supporting a sling of the embodiment of FIG. 1.

In a second variation, as shown in FIG. 9, the frame interface elements 48 of the seat back portion 50 couple to the second pair of collapsible bars 16 and the frame interface elements 48 of the seat bottom portion 46 couple to the first pair of collapsible bars 14 such that the brace 12 is substantially adjacent or behind the seat back portion 50 of the sling. The sling can be made of a durable and/or waterproof material such as fabric, vinyl, or plastic, but may alternatively be made out of any suitable material.

The sling 44 of the described embodiments also includes a shaping element that functions to provide a "bucket" shape to the sling 44, which prevents the user from sliding forward out of the seat, especially when their feet are not firmly planted. The shaping element can also functions to allow the sides of the sling 44 to better contain the users' hips and to provide better back support. The shaping element can be one of several variations. In a first variation, the shaping element is a gusset 52, as shown in FIG. 2, which runs from the seat bottom portion to the seat back portion. The gusset 52 can be diamond or lozenge shaped, but may alternatively have any other suitable geometry. In a second variation, the shaping element includes darts in the seat bottom portion of the sling. The darts may alternatively be located near the edges of the sling, but may alternatively be in any suitable portion of the sling to provide a "bucket" shape to the sling 44. In a third variation, the shaping element is a panel or portion of the sling made out of a stretchable fabric, such that the sling can expand to provide a "bucket" shape to the sling 44 when the user sits into the portable chair. The shaping element may alternatively be any other suitable shaping element that functions to provide a "bucket" shape to the sling 44 and allow the sides of the sling 44 to better contain the users' hips.

Figure 10:
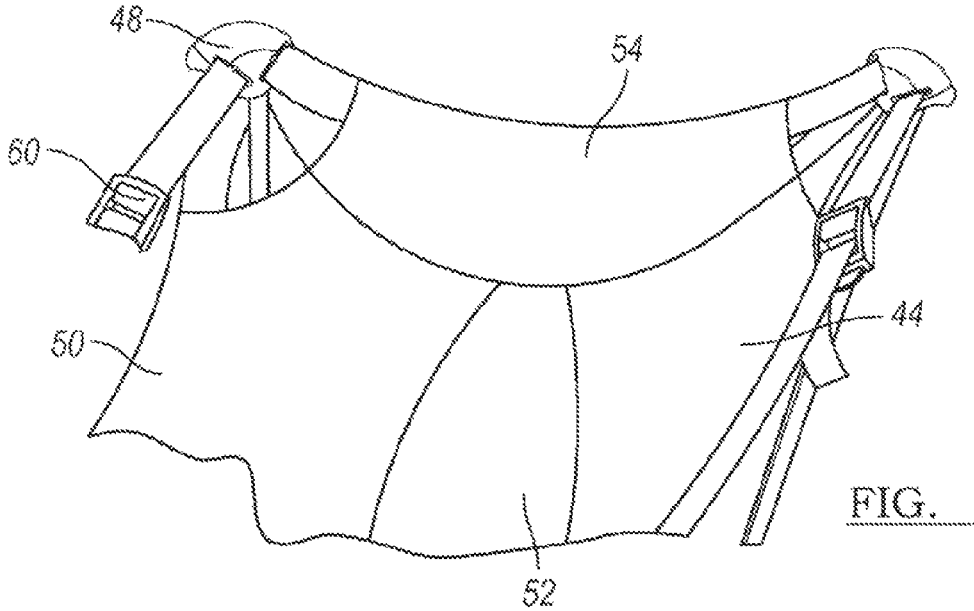
FIG. 10 illustrates the sling for the embodiment of FIG. 1.

The sling 44 of the described embodiments also includes a weight distribution element that functions to reduce the pressure of the sling 44 against the back of the user. The weight distribution element can be one of several variations. In a first variation, the weight distribution element is a panel 54, as shown in FIG. 10, in the seat back portion 50 of the sling that couples the two frame interface elements 48 to one another. The panel 54 can be semi-circular or crescent shaped such that when the weight of the user is applied to the sling, the top portion supports a first amount of weight and the bottom rounded portion supports a second amount of weight. The second amount of weight is larger than the first amount due to the orientation of the bottom rounded portion with respect to the frame of the chair. The top portion is substantially perpendicular to the collapsible bar coupled to the seat back portion of the sling, and the bottom rounded portion, where it couples to the frame, is substantially parallel or inline with the collapsible bar such that the majority of the weight supported by the sling is supported by the bottom rounded portion rather than the top portion. The second amount of weight is larger than the first amount of weight to reduce the tension on the upper sling edge 55 and reduce its pressure against the back of the user. The weight distribution element may alternatively be any other suitable variation to reduce the pressure of the upper sling edge 55 against the back of the user.

In one variation, as shown in FIG. 2, the sling 44 includes multiple panels. The panel 54 at the top portion of the seat back portion 50 of the sling 44 has a semicircle shape and is positioned in the sling 44 such that the curved portion is lower than the straight portion. The three remaining panels radiate from curved portion of panel 54. One of those three panels is the gusset 52. The gusset 52 runs from the panel 54 to the bottom of the sling. Mirrored around the gusset 52 are two rectangular panels. The two outside panels are substantially flat (i.e. not bucket shaped), but may alternatively include darts or any other suitable shaping element. The two outside panels may alternatively each be replaced by a two triangular panels, or may alternatively include any other suitable number of panels. The two triangular panels are substantially "30-60-90" triangles with the 90 degree angles adjacent to the gusset 52 at the bottom of the sling. On the outside of those two panels, are two more similarly shaped panels with the 90 degree angles located at the far outside, top corners of the sling. The two outside panels (each including two triangular panels) on each side of the gusset 52 form a rectangle on either side of the gusset 52.

Figure 11A:
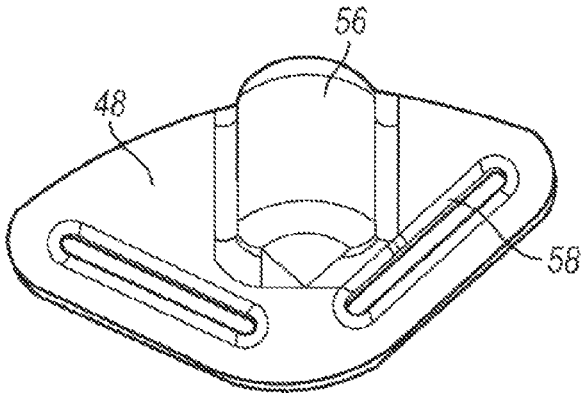
FIGS. 11A and 11B are front and back views respectively of the frame interface element for the embodiment of FIG. 1.
Figure 11B:
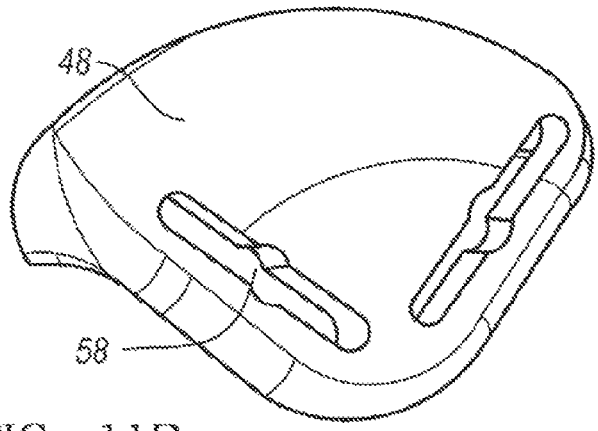

The frame interface elements 48 of the described embodiment function to couple the sling 44 to the portable chair frame 10. In a first variation, as shown in FIGS. 11A and 11B, the frame interface elements 48 each define a receiving element 56 that receives a portion of a collapsible bar and define a slot 58 that receives a portion of the sling 44. The frame interface element 48 defines the receiving element 56 such that it holds the portion of the collapsible bar at a predetermined angle relative to the sling 44 and to the other collapsible bars. The frame interface element 48 has a triangular geometry with two slots 58. The slots are about one inch wide and located on the triangular face approximately 100 degrees from each other. A portion of the sling (i.e. a strap coupled to the sling 44) is coupled to each of the slots of the frame interface element 48. In this variation, there is a left and right handed version of the frame interface element 48 such that the left handed and the right handed version each hold the portion of the collapsible bar at a predetermined angle (depending on the left or right side of the sling) relative to the sling 44 and to the other collapsible bars. The frame interface element 48 of this variation has a rounded edge along the top portion of the frame interface element 48 to prevent pressure or discomfort to the user. The frame interface elements can be made from metal, plastic, polycarbonate, or any other suitable material.

The frame interface elements may be machined, injection molded, or manufactured in any other suitable fashion. In a second variation, frame interface elements 48 are grommets or washers coupled to or sewn into the sling 44 that slide over or otherwise couple to the second ends 24 of the collapsible bars. In a third variation, the frame interface elements 48 are pockets that are coupled to or sewn into the sling 44 that slide over or otherwise couple to the second ends 24 of the collapsible bars.

The sling 44 of the described embodiments can also includes an adjustment element 60, as shown in FIGS. 2 and 10, that couples the seat bottom portion 46 to the seat back portion 50 and the length of the adjustment element 60 may be lengthened or shortened to increase or decrease the distance and the angle between the seat bottom portion 46 and the seat back portion 50. The sling 44 may further include straps coupled to the frame interface element 48 that run along the slide of the sling 44. The adjustment elements 60 are coupled to these straps and function to lengthen and shorten the lengths of these straps. The adjustment element 60 can be a ladder-lock buckle, but may alternatively be any suitable adjustment element 60 that increases or decreases the distance and the angle between the seat bottom portion 46 and the seat back portion 50. The sling 44 may also include additional adjustment elements 60 at any suitable location on the sling 44 or the portable chair frame 10.

III. Additional Portable Chair Elements

The portable chair frame 10 of the described embodiments can also include a cord 62 that functions to couple the elements of the portable chair frame 10 together, as shown in FIG. 6. The first bar section 30 and the second bar section 32 can be hollow such that the cord 62 can couple the inside of the first bar section 30 to the inside of the second bar section 32. The cord can run through the bar sections of a collapsible bar, through the brace, through the bar sections of a second collapsible bar, and through a joint 18 if one of the collapsible bars includes a joint 18. The portable chair frame 10 can include two cords 62 that run through the structure from the corners (the sling interfaces) and function to pull the bar sections, brace, and joints together. The cord 62 can be an elastic cord, but may alternatively be any other suitable material such as fabric, plastic, metal, or a metal spring.

The portable chair frame 10 of the described embodiments may also include a pad. The pad may be coupled to the sling 44 at the seat back portion and/or the seat bottom portion, but may alternatively be coupled to any other suitable portion of the sling and/or the frame. In a first variation, the pads are cushions that are insertable in pockets defined by the sling. The user may insert and remove pads of varying thickness and/or density. In a second variation, the pads are inflatable. In this variation, the pads can be coupled to the sling and include a valve through which they are inflated.

The portable chair frame 10 of the described embodiments may also include rockers. The rockers can be coupled to the joints 18, but may alternatively be coupled to any suitable portion of the portable chair frame 10. The rockers can be standard rockers as conventionally found on standard rocking chairs. The rockers can be rounded bands of material such as wood, metal, or plastic and couple to the ground surface such that the portable chair frame 10 may rock back and forth.

Figure 12A:
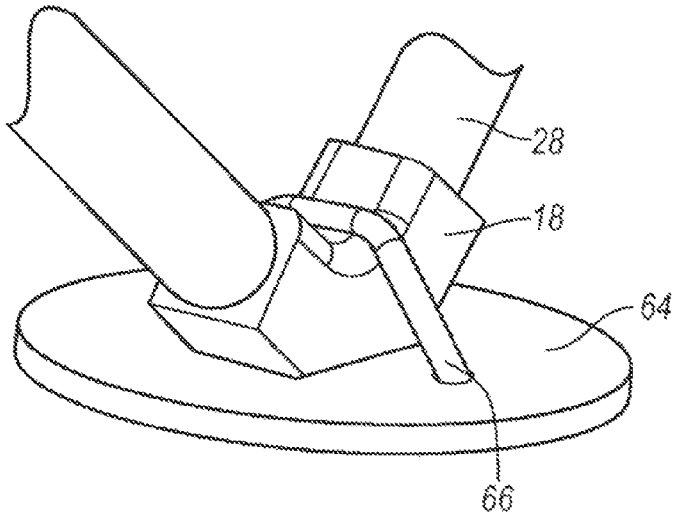
FIGS. 12A and 12B illustrate a first variation and a second variation respectively of the base for the embodiment of FIG. 1.
Figure 12B:
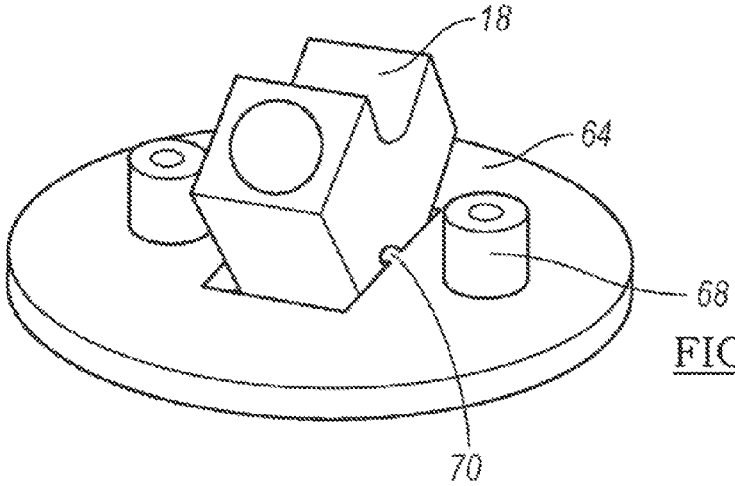
Figure 13:
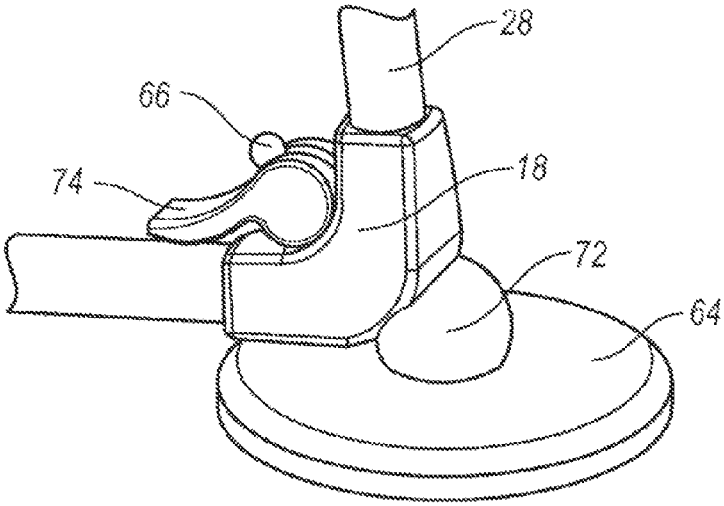
FIG. 13 illustrates a third variation of the base for the embodiment of FIG. 1.

The portable chair frame 10 of the described embodiments can also include a base 64, coupled to the joint 18, that cooperates with the joint 18 to provide a point of contact with the ground surface 20 with an increased surface area, as shown in FIGS. 12A, 12B, and 13. The joints 18 alone provide a point of contact with a ground surface and are ideal for gripping rocks, logs, and hard ground in general. On soft ground such as sand or grass, they may sink into the ground surface. The base 64 coupled to the joint 18, cooperates with the joint 18 to provide a point of contact with the ground surface 20 with an increased surface area such that the joint 18 and base 64 will not sink into the ground surface. The base 64 is removable from the portable chair frame 10, but may alternatively be permanently attached to a portion of the portable chair frame 10. The base 64 is circular and defines a square hole that couples to the joint 18, but may alternatively have any suitable geometry. The base can be made from metal, plastic, polycarbonate, or any other suitable material. The base may be machined, injection molded, or manufactured in any other suitable fashion. In a first variation, as shown in FIGS. 12A and 12B, the base 64 can include a cable 66 that couples the base 64 to the joint 18. The cable 66 can be an elastic cable, but may alternatively be made out of rubber, plastic, fabric, or metal. In a second variation, as shown in FIG. 12B, the base 64 can be injection molded part and includes two hollow bosses 68, located on the upper surface of the base 64 that contain the ends of the cable 66. In this variation, the base 64 may further include tab portions 70 that snap into the joint 18, as shown in FIG. 12B.

In a third variation, as shown in FIG. 13, the base includes a spherical indent on the top side and a center hole with a countersink on the bottom side to hold the cable 66 in place. The depth of the indent and the top surface of the base are contoured in such a way that, on a level ground surface, joint 18 will only hit the base 64 when the portable chair frame is tilted past the point where the pair of collapsible legs that couple to the seat bottom portion of the sling are horizontal or in the opposite direction, past the point where the pair of collapsible legs that couple to the seat back portion of the sling are horizontal. The base 64 can be contoured in such a way that if the bottom (or back) of the joint 18 does contact the base 64, it does so along its entire surface to avoid a lever action, which would overstress the joint. The base 64 in this variation can be injection molded, but may be manufactured in any other suitable fashion.

The base 64 also includes a coupler 72 that can be spherical in shape and dimensioned to couple with the spherical indent in the base 64. The coupler 72 has an hourglass shape hollowed out of the inside of the sphere, such that it provides enough room for the cable 66 in any position that the base 64 and joint 18 can assume. The coupler 72 also keeps the cable at a substantially constant tension as it bends around the center of the coupler 72. The coupler 72 can be injection molded, but may be manufactured in any other suitable fashion. The cable 66 in this variation, can be made from an artificial fiber like nylon or a metal such as steel and may include an elastic element. At a first end of the cable 66, the cable includes a cone shaped plug that interfaces with the countersink geometry of the base 64. At the second end of the cable 66, the cable includes a ball dimensioned such that it can be inserted through a hole in the joint 18 and held by the cam buckle 74 on the opposite side. The cam 74 can be a cylinder with a finger-sized handle. The cam 74 can be slotted to accept the thickness of the cable 66 and has a pocket on the top side to accept the cable ball. The cam 74 can be a standard cam, but may alternatively be any suitable device. The joint 18 in this variation becomes broader towards the back and has a spherical divot to accept the coupler 72. At the crook of the L-shaped joint 18 there is a cylindrical surface for the cam 74 to ride in. It can include a hole from the center of the rear divot to the center of the crook of the L to accept the cable 66. The joint 18 in this variation can be CNC machined aluminum, but may alternatively be any other suitable material machined in any suitable fashion.

Figure 14:
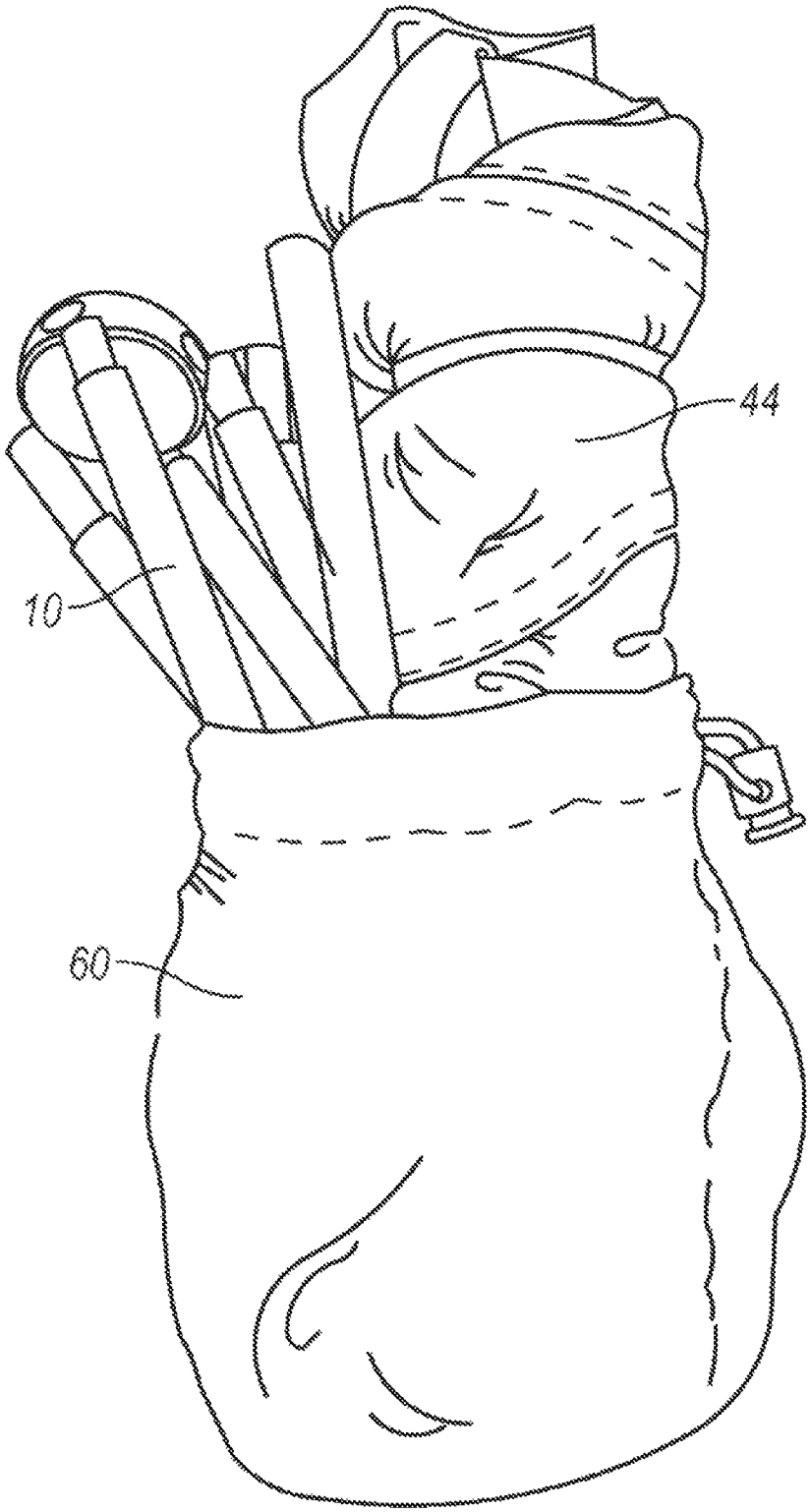
FIG. 14 shows the bag for storing the embodiment of FIG. 1.

The portable chair frame 10 of the described embodiments may also includes a bag 68, as shown in FIG. 14, which functions to store the portable chair frame 10 and the sling 44, when they are collapsed and folded. The bag 68 has a length less than 10 inches (ideally less than or equal to 7 inches) and a diameter less than 5 inches (ideally less than or equal to 4 inches), but may alternatively have any suitable dimensions to store the portable chair frame 10 and/or the sling 44, when they are collapsed and folded. The sling can be removed from the portable chair frame when they are collapsed and folded, but alternatively, the sling may remain coupled to the portable chair frame when they are collapsed and folded and/or the sling and frame may open in a fashion similar to the opening and closing mechanism of an umbrella, i.e. the portable chair frame and/or sling may pop open in a smooth motion similar to that of an umbrella opening and unfolding in one fluid motion.

IV. Additional Portable Chair Embodiments

Figure 15A:
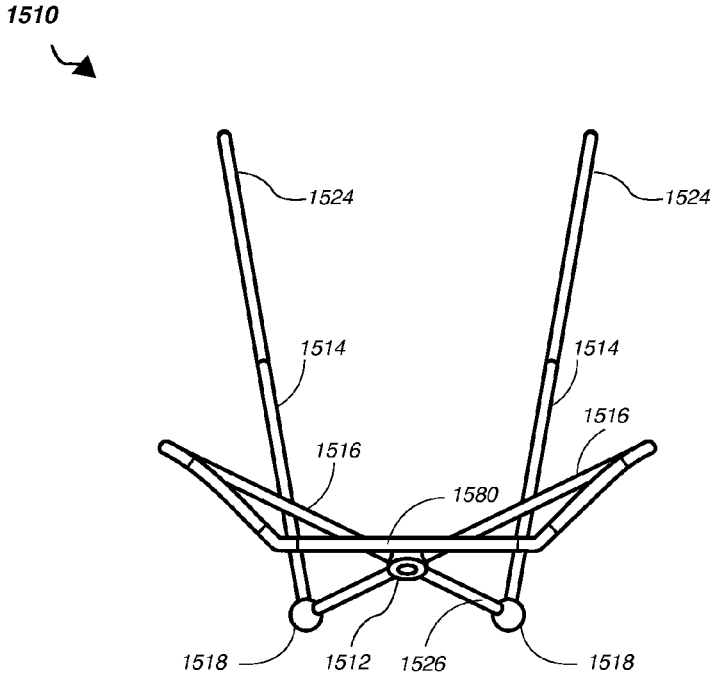
FIGS. 15A and 15B are perspective views illustrating another embodiment of a portable chair frame in accordance with the present invention.
Figure 15B:
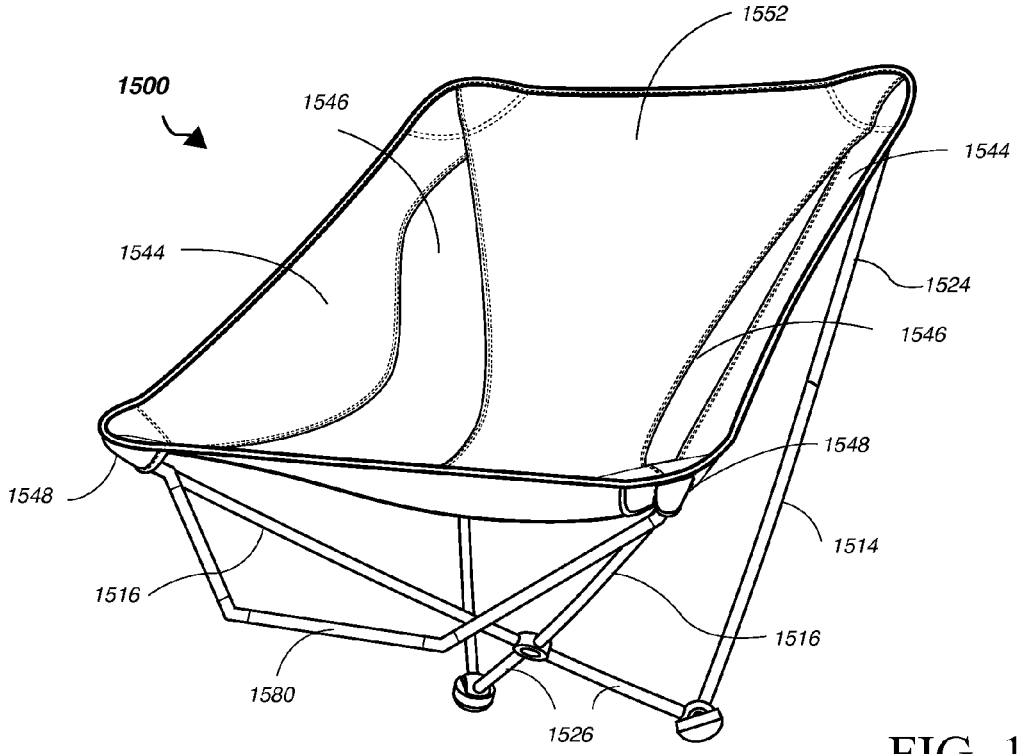

FIGS. 15A and 15B are perspective views illustrating another embodiment of a portable chair 1500 having a chair frame 1510 and sling sections 1544, 1546 & 1552, in accordance with the present invention. Chair frame 1510 has similar components to those of the above-described chair frame 10, including a first pair of collapsible bar sections 1514, 1524 a second pair of collapsible bar sections 1516, 1526, brace 1512, and two joints 1518 that each provide a point of contact with a ground surface (not shown). Construction, field assembly and functionality of chair frame 1510 and sling sections 1544, 1546 & 1552 are substantially similar to that described above for the portable chair components including chair frame 10, sling 44 and gusset 52 of FIG. 2.

For example, the first pair of collapsible bar sections 1514, 1524 are coupled to each other in a manner similar to that described above for collapsible bar 28 having first and second bar sections 30, 32 that are removably coupled as illustrated by FIG. 6. Accordingly, the first bar section 1514 has an end portion with an outer diameter dimension, and the second bar section 1524 has an end portion that defines a recess that receives the outer diameter dimension of the end portion of the first bar section 1514.

Sling sections 1544 and 1552 can be made from a suitable lightweight nylon material, while sling section 1546 can be made from a mesh material for improved air ventilation and/or conformity with the user's body. Four frame interfaces 1548, described in greater detail below, are securely attached to the four respective corners formed by sling sections 1544 and 1552.

Figure 16:
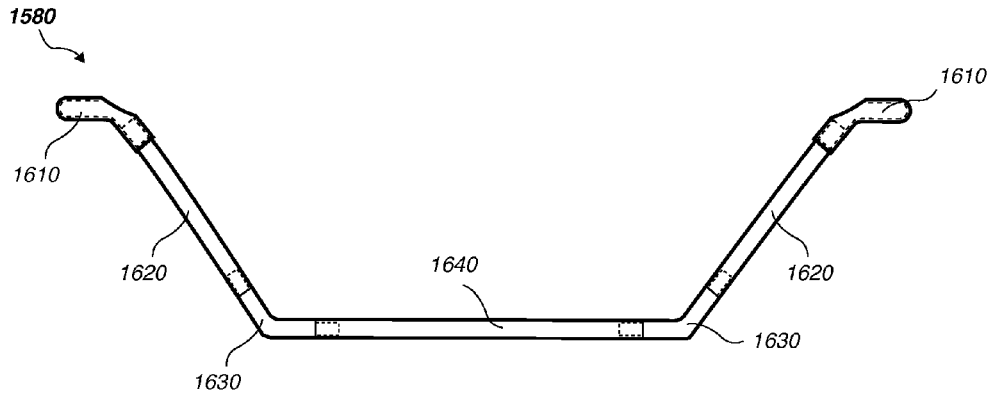
FIG. 16 is a perspective view of the optional front foot assembly for the embodiment of FIGS. 15A and 15B.
Figure 17:
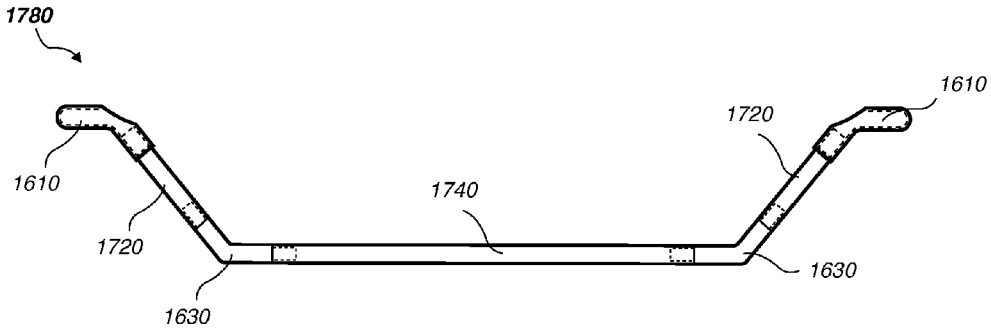
FIG. 17 is a perspective view of a variation of the front foot assembly of FIG. 16 suitable for portable chairs in accordance to the present invention.

In this embodiment, portable chair frame 1510 also includes an optional front support assembly 1580 which is shown in greater detail in the perspective view of FIG. 16. Front support assembly 1580 provides additional stability for a user sitting in chair 1500. Assembly 1580 includes a pair of connectors 1610, a pair of diagonal bars 1620, a pair of couplers 1630, and a bottom bar 1640. The respective lower ends of diagonal bars 1620 are coupled to opposite ends of bottom bar 1640 via couplers 1630.

Figure 18A:
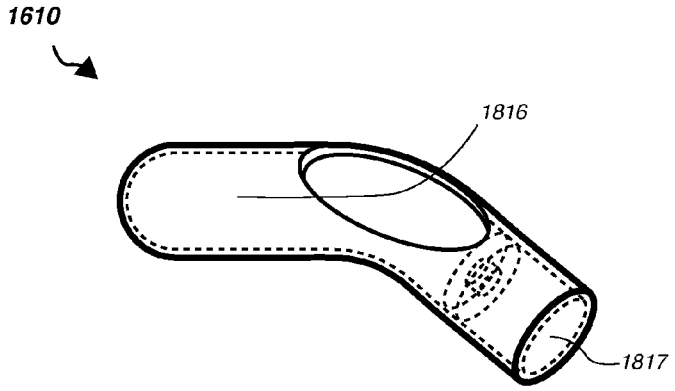
FIGS. 18A and 18B are perspective and cross-sectional views, respectively, of an exemplary connecting joint for the front foot assemblies of FIGS. 16 and 17.
Figure 18B:
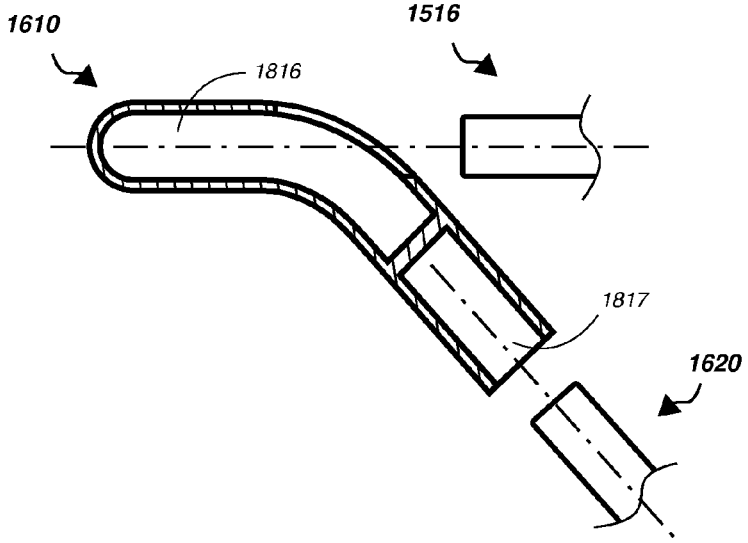

Referring also to FIGS. 18A and 18B which are perspective and cross-sectional views, respectively, of exemplary connector 1610, connector 1610 has a first recess 1816 configured to rotatably secure collapsible bar 1516, and a second recess 1817 to rotatably secure an upper end of diagonal bar 1620. Note that connector 1610 is also configured to be coupled to the front frame interfaces 1548, attached to the sling sections 1544 and 1552.

Figure 18C:
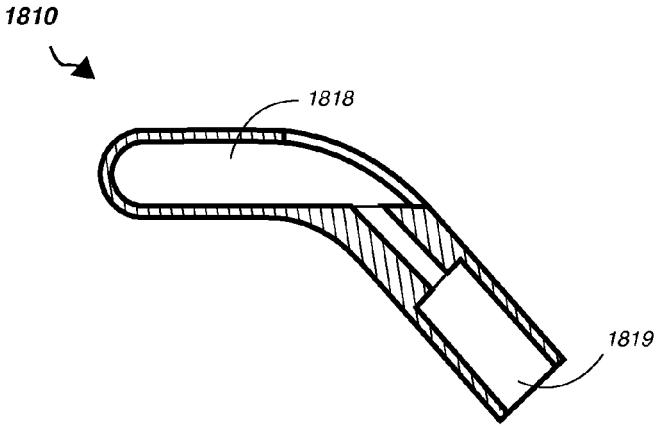
FIG. 18C is a cross-sectional view showing a variant of the machined connecting joint of FIG. 18B.

Connecting joint 1610 can be made from suitable material such as a metallic or plastic casting. FIG. 18C is a cross-sectional view showing another embodiment of a connector 1810 having machined recesses 1818, 1819 suitable for securing bars 1516, 1620, respectively.

Figure 21A:
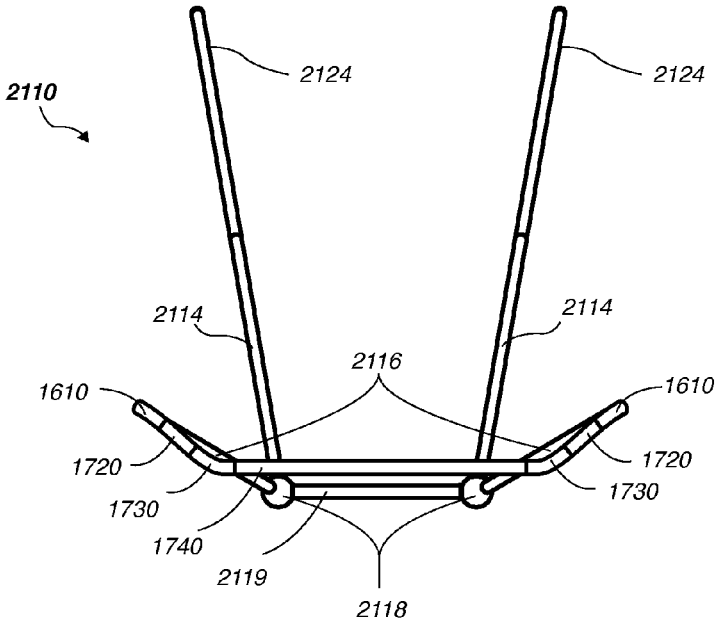
FIGS. 21A-21D are perspective views illustrating another embodiment of a portable chair, in accordance with the present invention.
Figure 21B:
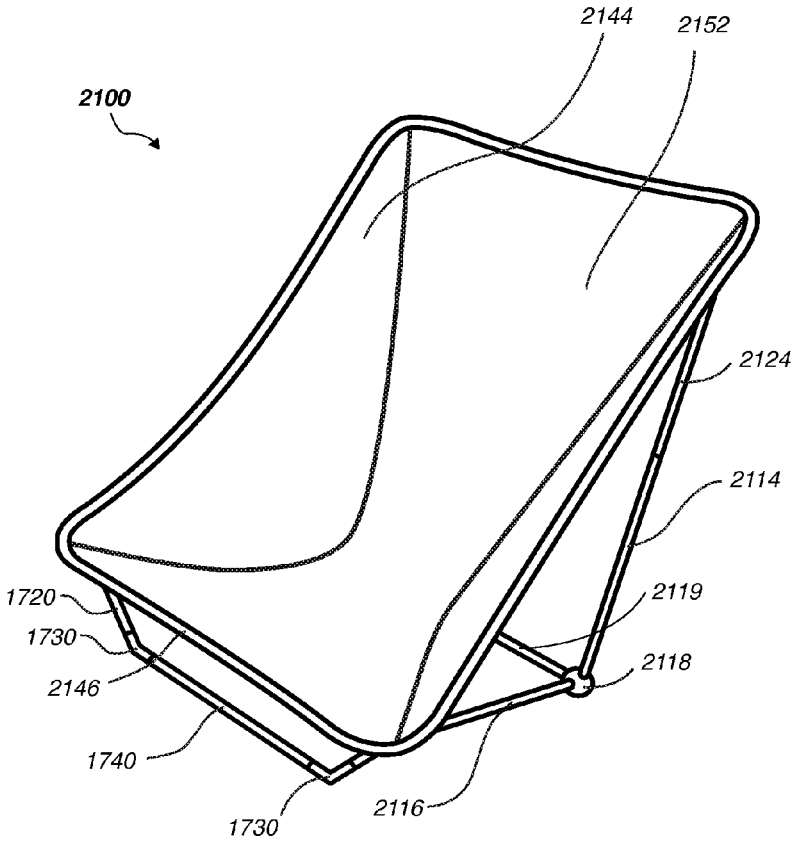
Figure 21C:
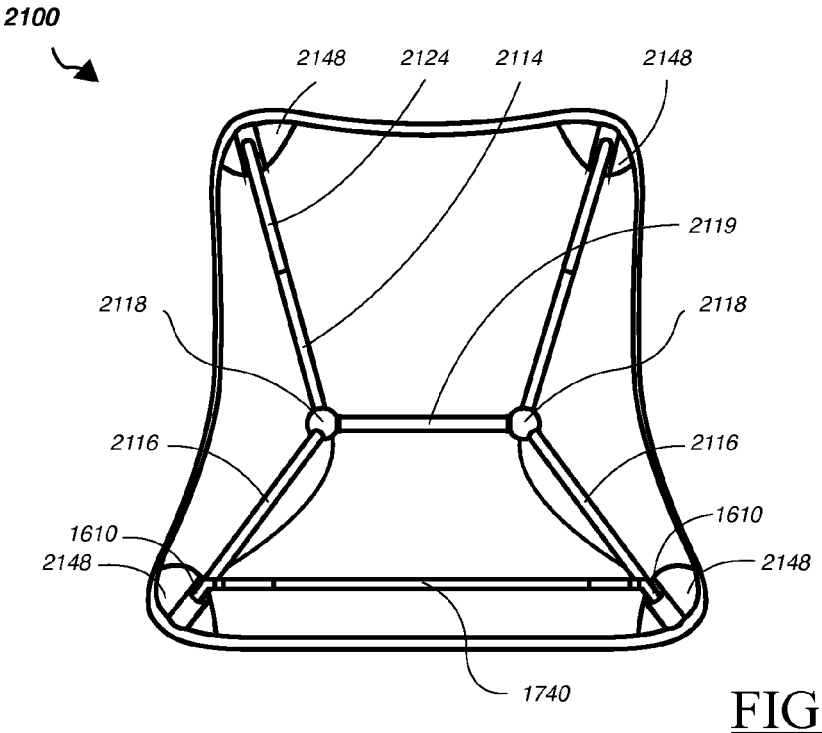
Figure 21D:
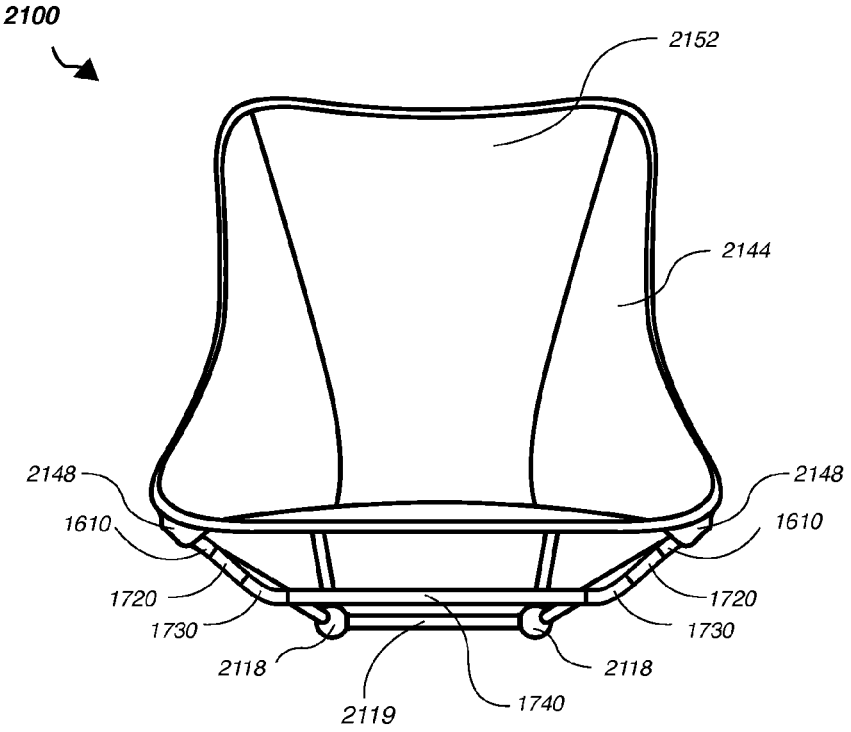

FIGS. 21A-21D are perspective views illustrating another embodiment of a portable chair 2100 having a chair frame 2110 and sling sections 2144, 2152, in accordance with the present invention. FIG. 21A shows a chair frame 2110 of chair 2100. FIGS. 21B, 21C and 21D show side, back and front views of portable chair 2100. Chair frame 2110 includes a first pair of collapsible bar sections 2114, 2124 a second pair of collapsible bars 2116 and two joints 2118 that each provide a point of contact with a ground surface (not shown). Construction, field assembly and functionality of chair frame 2110 and sling sections 2144, 2152 are somewhat similar to that described above for the components of portable chair 1500.

In this embodiment, the lower ends of bar sections 2114 and bars 2116 are coupled to each other via joints 2118. In addition, joints 2118 are coupled to each other via a bottom bar 2119. Portable chair frame 2110 can include an optional front support assembly 1780 which is shown in greater detail in the perspective view of FIG. 17. Front support assembly 1780 provides additional stability for a user sitting in chair 2100. Assembly 1780 includes a pair of connectors 1610, a pair of diagonal bars 1720, a pair of couplers 1630, and a bottom bar 1740. The respective lower ends of diagonal bars 1720 are coupled to opposite ends of bottom bar 1740 via couplers 1630. Connectors 1610 are configured to be coupled to front frame interfaces 2148 of the sling sections 2144, 2152.

Figure 19A:
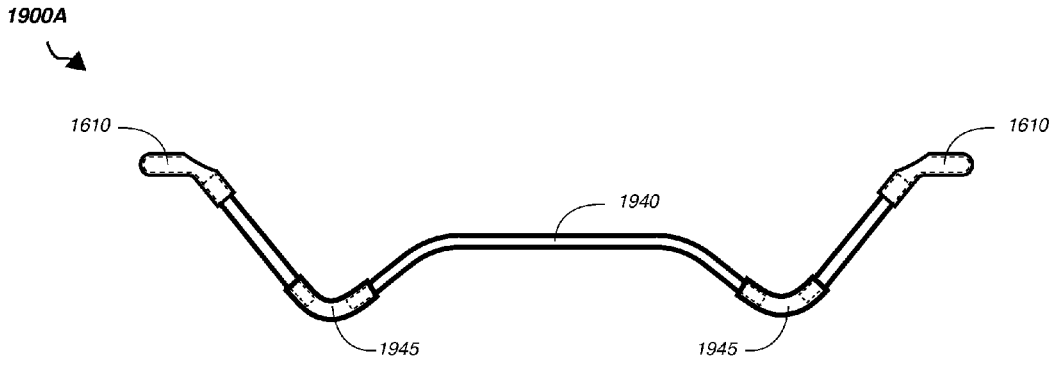
FIGS. 19A, 19B and 19C are perspective views of alternate front foot assemblies for portable chairs in accordance with the present invention.
Figure 19B:
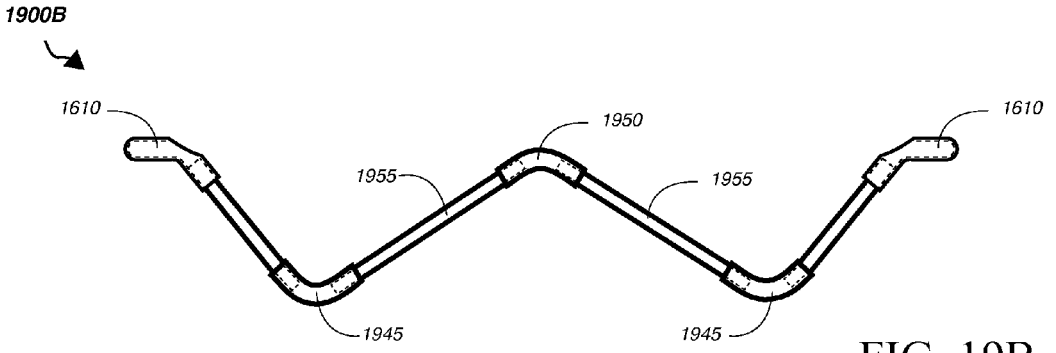
Figure 19C:
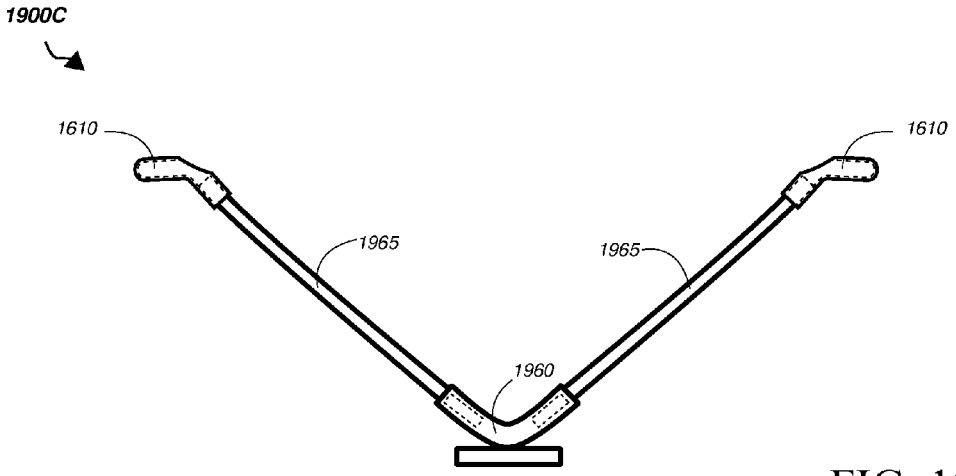

FIGS. 19A and 19B are perspective views of alternate exemplary front support assemblies 1900A and 1900B suitable for portable chairs such as chairs 1500, 2100. FIG. 19C shows yet another exemplary embodiment of a front support assembly 1900C. Adding front foot assembly 1900C to a portable chair creates a three ground contact points with a ground surface, thereby increasing stability especially for uneven ground surfaces.

Figure 22A:
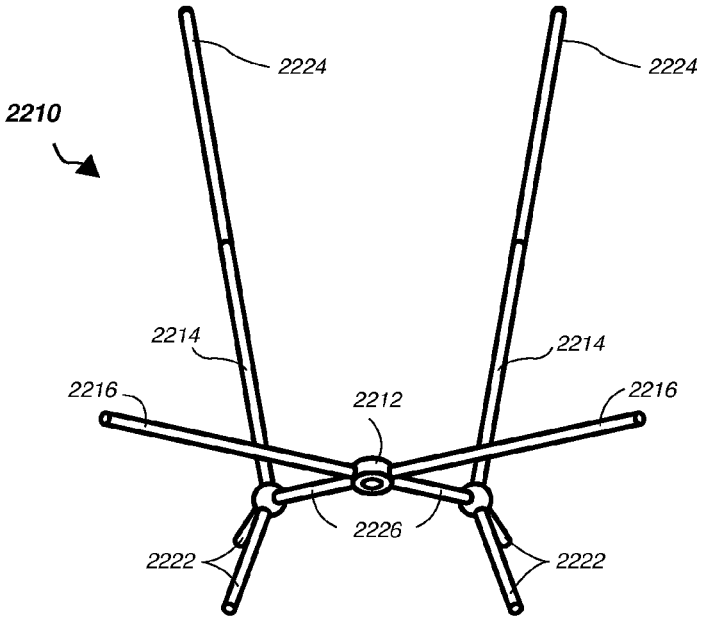
FIGS. 22A-22D and 23A-23C are perspective views illustrating two additional embodiments of portable chairs having bipod legs, in accordance with the present invention.
Figure 22B:
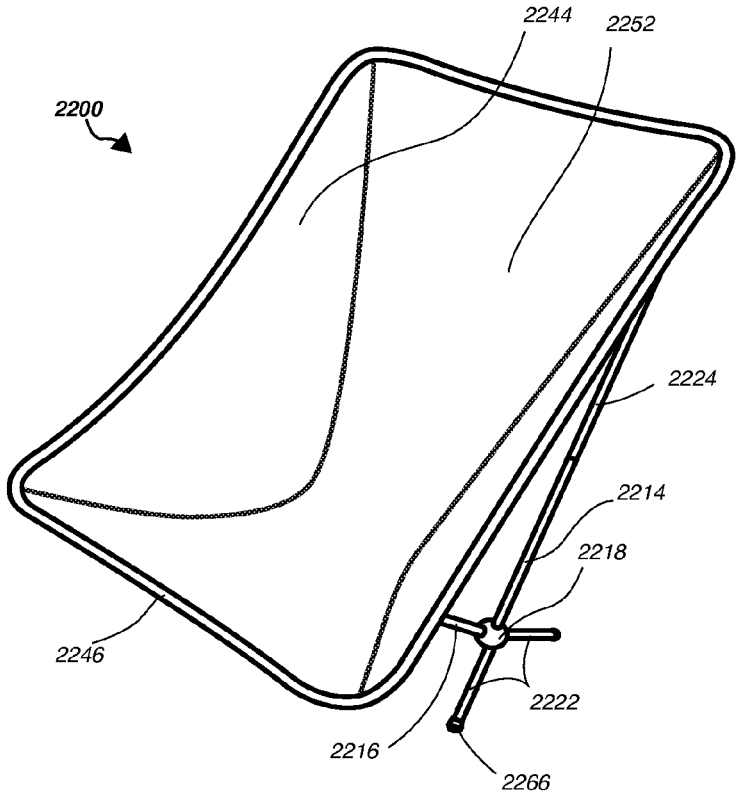
Figure 22C:
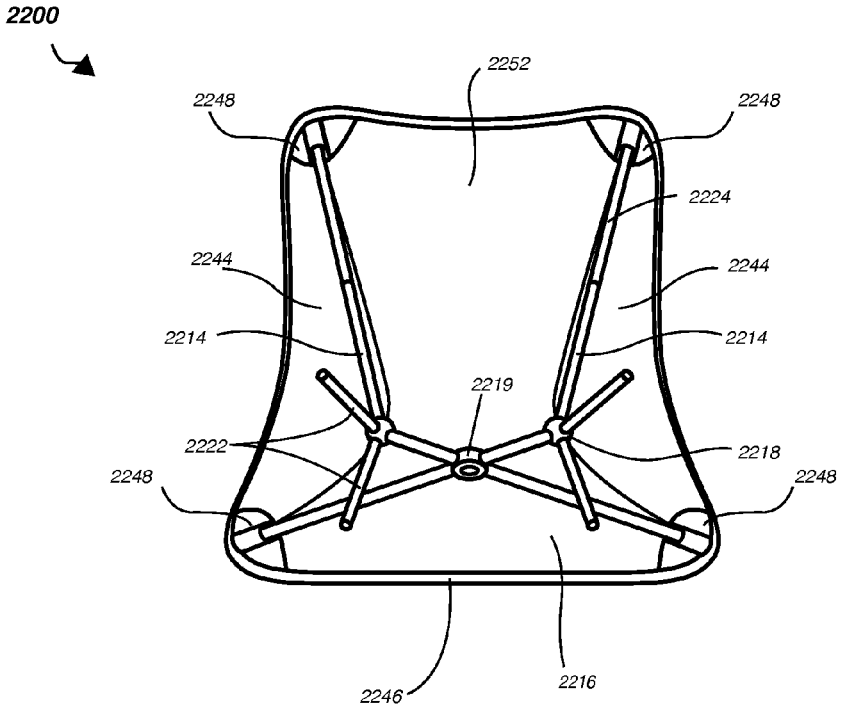
Figure 22D:
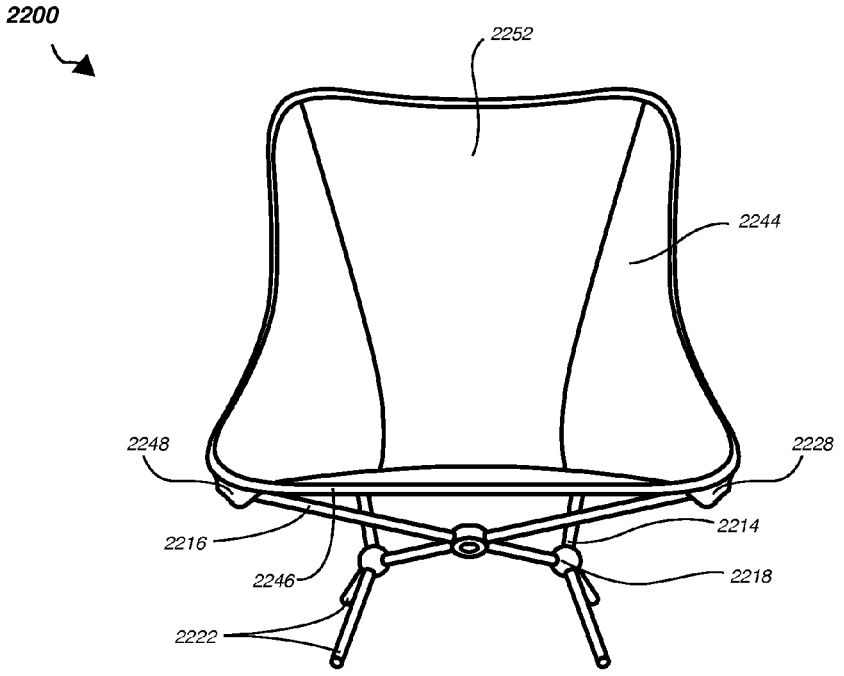

FIGS. 22A-22D are perspective views of an additional embodiment of a portable chair 2200 having a chair frame 2210 and sling sections 2244, 2252, in accordance with the present invention. FIG. 22A shows chair frame 2210 while FIGS. 22B, 22C and 22D show side, back and front views of portable chair 2200.

Chair frame 2210 has similar components to those of the above-described chair frame 1510, including a first pair of collapsible bar sections 2214, 2224 a second pair of collapsible bar sections 2216, 2226, brace 2212, and two joints 2218 each coupled to a corresponding pair of bipod legs 2222. Construction, field assembly and functionality of chair frame 2210 and sling sections 2244, 2252 share some similarities with the components of portable chairs 1500 and 2100 described above.

In this embodiment, stability for a user sitting in chair 2100 is accomplished by bipod legs 2222 providing four points of contact with the ground surface as illustrated by FIG. 22D. Bar sections 2214, 2226 and bipod legs 2222 can be coupled to joints 2218 in a manner similar to that described below for joint 2318 and bar section 2314, bar 2316 and bipod legs 2222 as illustrated by FIG. 24.

Figure 23A:
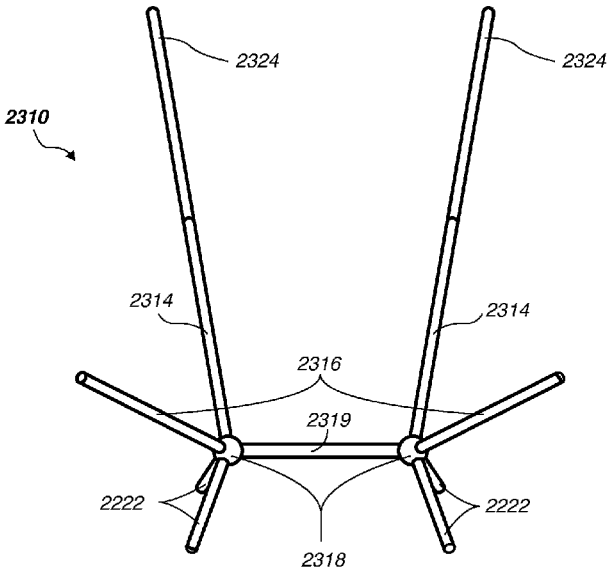
Figure 23B:
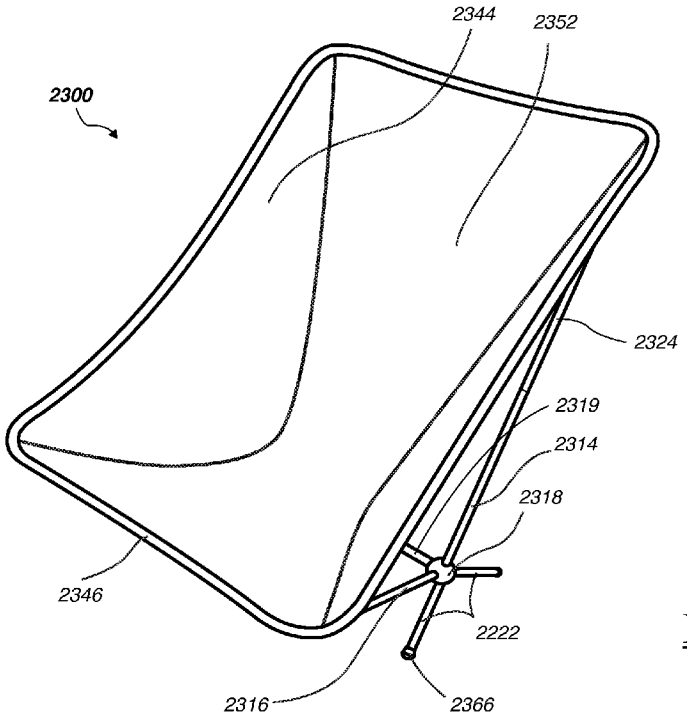
Figure 23C:
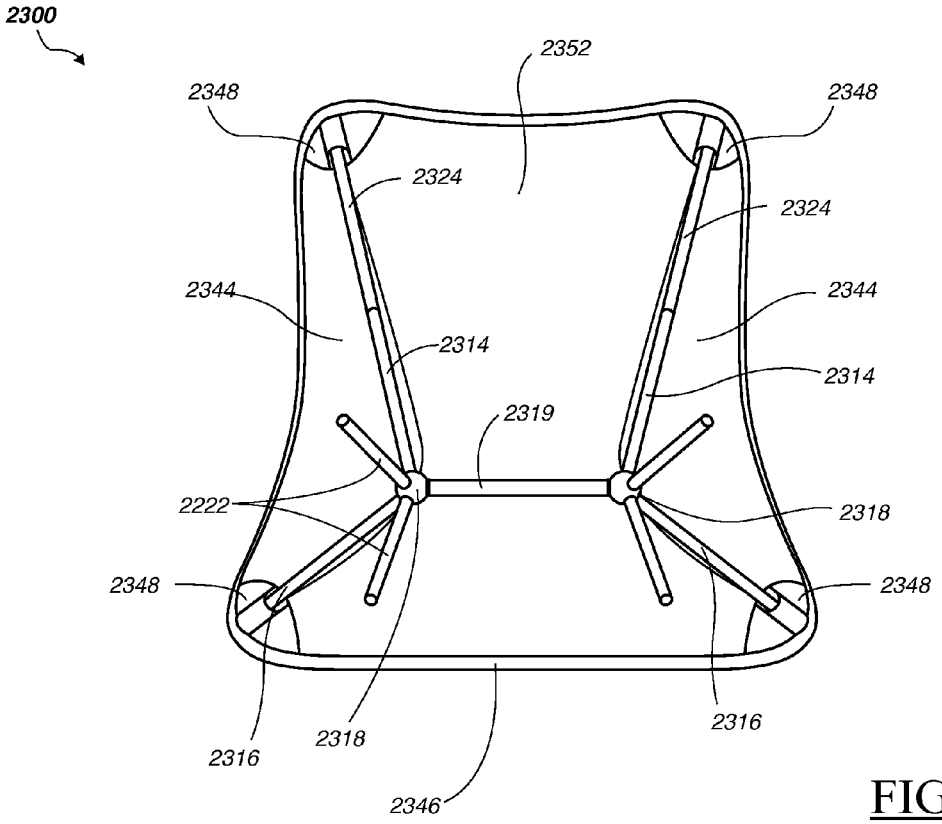

FIGS. 23A-23C are perspective views illustrating yet another embodiment of a portable chair 2300 with chair frame 2310 and sling sections 2344, 2352, in accordance with the present invention. FIG. 23A shows chair frame 2310 while FIGS. 23B and 23C show side and back views of portable chair 2300. Chair frame 2310 includes a first pair of collapsible bar sections 2314, 2324 a second pair of collapsible bars 2316 and two joints 2318 each coupled to a corresponding pair of bipod legs 2222. Construction, field assembly and functionality of chair frame 2310 and sling sections 2144, 2152 share some similarities to that described above for portable chairs 1510, 2100 and 2210.

In this embodiment, the lower ends of bar sections 2314 and bars 2316 are couple to each other via joints 2318. In addition, joints 2318 are coupled to each other via a horizontal bar 2319. Additional stability for a user sitting in chair 2300 is accomplished by bipod legs 2222 providing four points of contact with the ground surface as illustrated by FIGS. 23A and 23B.

Figure 24:
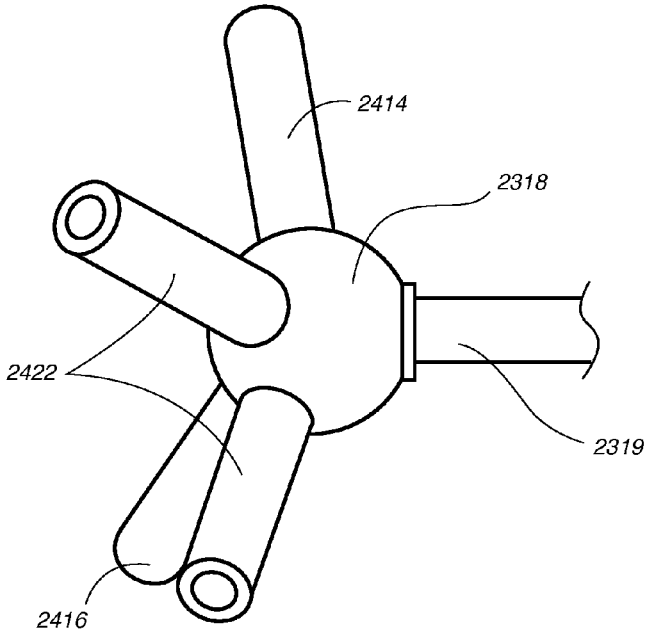
FIG. 24 is a perspective view of an exemplary ball joint useful constructing some of the embodiments of the portable chairs described.

FIG. 24 is a perspective view of exemplary joint 2318 with four stubs 2414, 2416, 2422 configured to snugly couple with corresponding ends of bar section 2314, bar 2316 and bipod legs 2222, in a manner similar to that described above for collapsible bar 28 and as illustrated by FIG. 6. For example, the external diameters of stubs 2414, 2416, 2422 are appropriately selected to receive the respective end internal diameters of bars 2314, 2316 and legs 2222.

Figure 20A:
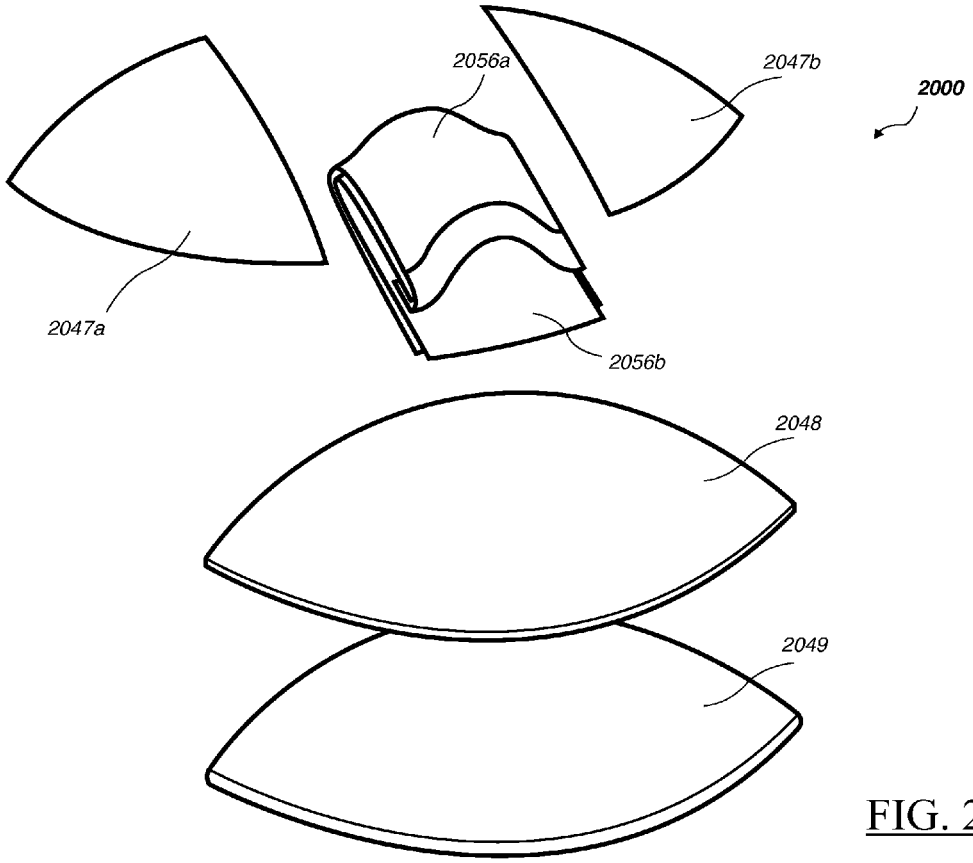
FIGS. 20A and 20B are exploded and assembled views, respectively, of the frame interface suitable for the portable chair slings in accordance with the present invention.
Figure 20B:
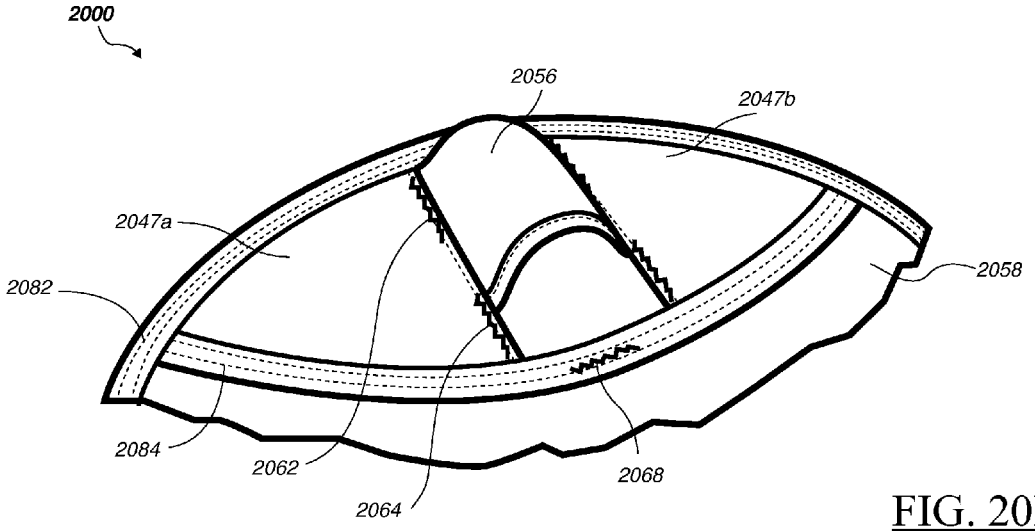

Referring now to FIGS. 20A and 20B, exploded and assembled views, respectively, of an exemplary frame interface 2000 suitable for coupling slings to the respective frames of the portable chairs, e.g., chairs 1500, 2100, 2200 and 2300, frame interface 2000 includes reinforcing layers 2047*a*, 2047*b*, 2056*a*, pocket layer 2056*b*, stiffening layer 2048 and backing layer 2049.

In some embodiments, reinforcing layers 2047*a*, 2047*b*, 2056*a* can be made from the same lightweight material as sling sections 1544, 1552, e.g., ripstop nylon. Pocket layer 2056*b* can be made from a suitable thick and strong material such as nylon webbing. Stiffening layer 2048 can be mode from a suitably stiff material such as High Density Polyethylene (HDPE), while backing layer 2049 can be made from a suitably material such as Ethyl Vinyl Acetate (EVA). These layers can be stitched to form a pocket 2056 for sling section 2058, as shown in FIG. 20B together with edging tape 2082, 2084. Additional reinforcing stitches can also be applied to stress locations such as 2062, 2064, 2068.

The exemplary embodiments of the portable chairs described above can be made from a wide variety of suitable materials. For example, the frames can be constructed from one or more strong and lightweight materials including metallic alloys such as aluminum, titanium, magnesium and steel. It is also possible to use plastics such as polycarbonate or fiberglass, carbon fiber, and combinations thereof. It may also be possible to construct chair frames using natural materials such as bamboo. The chair slings can be made from suitable flexible materials such as nylon, canvas and jute and combinations thereof.

Many modifications and additions to the above described embodiments are possible. In addition, many of the portable chair components, including connectors, couplers and joints described above, can also useful for constructing other assemblies. For example, connectors 1610 described above for mounting front support assemblies 1580, 1780, 1900A, 1900B, 1900C to portable chairs also useful for mounting assemblies for other portable structures and furniture, including cots beds, tables, and shelters such as tents.

While this invention has been described in terms of several embodiments, there are alterations, modifications, permutations, and substitute equivalents, which fall within the scope of this invention. Although sub-section titles have been provided to aid in the description of the invention, these titles are merely illustrative and are not intended to limit the scope of the present invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A portable chair for accommodating a user in a seated position, the portable chair comprising:

a front pair of collapsible bars, each of the front pair of collapsible bars having a first end and a second end;

a back pair of collapsible bars, each of the back pair of collapsible bars having a first end and a second end;

a pair of back joints, each of the pair of back joints configured to be coupled to the corresponding first end of each of the front pair of collapsible bars and also to be coupled to the corresponding first end of the back pair of collapsible bars, and wherein the pair of back joints are further configured to contact a ground surface;

a center bar configured to securely couple the pair of back joints to each other;

a front chair support having a pair of front joints, each of the pair of front joints configured to be coupled to a corresponding second end of the front pair of bars, wherein the front chair support is further configured to contact the ground surface; and a sling for accommodating a user in a seated position, wherein the sling includes a pair of front frame interfaces configured to be coupled to the corresponding second end of each of the front pair of collapsible bars, wherein the sling also includes a pair of back frame interfaces configured to be coupled to the corresponding second end of the back pair of collapsible bars, and wherein the front joints of the front chair support are further configured to support corresponding front frame interfaces of the sling.

2. The portable chair of claim 1 further comprising an elastic cord configured to pass through at least one of the back pair of collapsible bars.

3. The portable chair of claim 1 wherein at least one of the back pair of collapsible bars comprises a first hollow bar and a second hollow bar, wherein the first hollow bar includes a first section of a first outer diameter and a second section of a second outer diameter less than the first diameter, and wherein the second section of the first hollow bar is configured to slide into a recess on one end of the second hollow bar, wherein the recess of the second hollow bar has an inner diameter slightly larger than the second outer diameter of the second section of the first hollow bar.

4. The portable chair of claim 1 further comprising an elastic cord configured to pass through at least one of the front pair of collapsible bars.

5. The portable chair of claim 1 wherein the front chair support is further configured to contact the ground surface on at least two points of contact.

* * * * *